United States Patent [19]

Hebert

[11] Patent Number: 4,640,633

[45] Date of Patent: Feb. 3, 1987

[54] HIGH-SPEED WIRE PRINT HEAD WITH WIRE PRINT POSITION SHIFT APPARATUS

[75] Inventor: Donald G. Hebert, San Ramon, Calif.

[73] Assignee: DH Technology, Inc., San Diego, Calif.

[21] Appl. No.: 710,633

[22] Filed: Mar. 15, 1985

Related U.S. Application Data

[63] Continuation-in-part of Ser. No. 592,400, Mar. 22, 1984, abandoned.

[51] Int. Cl.[4] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,759,359 | 9/1973 | Stellmach | 400/124 |
| 3,991,870 | 11/1976 | McIntosh | 400/124 |
| 3,991,871 | 11/1976 | McIntosh | 400/124 |
| 4,010,835 | 3/1977 | Martin et al. | 400/124 |
| 4,185,929 | 1/1980 | Hebert | 400/124 |
| 4,459,051 | 7/1984 | Kawai | 400/124 |

FOREIGN PATENT DOCUMENTS

| | | | |
|---|---|---|---|
| 52066 | 9/1981 | European Pat. Off. | 400/124 |
| 56-27363 | 3/1981 | Japan | 400/124 |
| 56-44676 | 4/1981 | Japan | 400/124 |
| 56-62165 | 5/1981 | Japan | 400/124 |
| 58-38175 | 3/1983 | Japan | 400/124 |

*Primary Examiner*—Edgar S. Burr
*Assistant Examiner*—David A. Wiecking
*Attorney, Agent, or Firm*—Klaas & Law

[57] ABSTRACT

A matrix head wire print position shift apparatus which includes a plurality of longitudinally movable print wires which are mounted in an elongated wire housing and are disposed in guides which movably support the longitudinally movable print wires for longitudinal movement within the housing in response to wire drive armatures which cause longitudinal movement of the movable print wires between a non-print position and a print position. A wire drive end bearing plate mounted in the housing supports the front end portions of the longitudinally movable print wires and is transversely shiftable relative to the housing between a first print position and a second print position by a transversely shiftable support device mounted in and guidably supported by the housing. In the first print position the print wire devices are selectably operable to print characters defined by a first set of adjacent substantially tangential circularly shaped dots. In the second print position the wire print devices are selectably operable to repeat printing of the characters with a second set of overlapping circular dots which are offset from the first sets of dots by approximately one half of the diameter of the first set of dots. The shift operating mechanism is mounted in the housing and includes a pivotally mounted rigid non-flexible armature plate member with a non-fixed pivotally movable end portion.

54 Claims, 43 Drawing Figures

HIGH-SPEED WIRE PRINT HEAD WITH WIRE PRINT POSITION SHIFT APPARATUS

This application is a continuation-in-part of my copending U.S. patent application Ser. No. 592,400 filed Mar. 22, 1984, and now abandoned, the benefit of which is claimed for this application.

BACKGROUND OF THE INVENTION

The present invention pertains generally to matrix wire printers and more particularly to movable wire print position shift apparatus utilized in matrix printers to provide high quality, high-speed printing characteristics.

A clear advantage of matrix printers over prior art printers, such as daisy wheel printers, is the ability of matrix printers, to provide high-speed printing in a device which is both economical and reliable in operation. Matrix printers utilize a series of print wires that are formed in a linear array having a closely spaced configuration in the vertical direction. Because the matrix print wires are circular in shape, the imprintation of the print wire forms a sequence of dots which approximates solid lines. Adjoining arcuate sections of the sequence of dots, however, produce void sections which degrade the quality of the print. In other words, a solid consistent imprintation to form a high quality solid line is not produced because of the voids generated by the adjoining arcuate sections.

These problems have been reduced by the prior art by providing a larger number of print wires to increase the imprintation area and form a more consistent solid line during imprintation. However, voids still exist between the joining arcuate sections so that the quality of the print continues to be somewhat degraded.

To overcome these disadvantages and limitations of the prior art, print heads with wire shifting apparatus were developed, such as disclosed in U.S. Pat. No. 4,010,835, issued Mar. 8, 1977, to Martin, et al, which are capable of reprinting a line of print with the printing wires shifted by a predetermined amount. Consequently, during the reprinting process imprintation is made in the voids between the dots to provide a more consistent imprintation which, consequently provides a much higher quality print.

Various other types of shifting mechanisms for wire matrix print head devices are shown in U.S. Pat. Nos. 3,759,359 of Stellmach, 3,882,985 of Liles, 4,400,101 of Hendrischk, and 4,459,051 of Kawai, the disclosures of which are incorporated herein by reference thereto. In general, these prior patents disclose the use of actuating mechanisms mounted externally of the wire housing for causing pivotal displacement of the entire wire housing or pivotal displacement of a wire bearing and guide member attached to a spring-type armature member mounted outside the wire housing. At the present time, there have been some attempts to mount pivotally supported wire shift apparatus within the confines of the wire housing by use of spring-type cantilevered armature support devices which are flexibly displaceable by associated electromagnetic apparatus.

Disadvantages of such prior art devices are that they are generally complex, expensive, lack efficiency, bulky and are not easily assembled or adjusted.

SUMMARY OF THE INVENTION

The present invention overcomes the disadvantages and limitations of the prior art by providing a print head which is simpler, less expensive, more efficient, more compact, less massive, and more quickly assembled and adjusted than existing matrix print head output guide shifting devices. The present invention utilizes simple parts which are fabricated from flat metal stampings and molded plastic parts.

In general, the present invention comprises: a matrix print head wire print position shift apparatus comprising longitudinally movable wire print means spaced about a longitudinal axis and being longitudinally movable between a non-print position and a print position within an elongated housing means made of one piece of molded plastic material having an U-shape cross-sectional configuration; guide means for movably supporting the longitudinally movable wire print means; wire drive armature means for inducing movement in the longitudinally movable wire print means between the non-print position and the print position; wire drive magnetic means having radially innermost and radially outermost pole portions and mounted in juxtaposition to a radially outer end portion of the wire drive armature means during movement between the non-print position and the print position and being selectively energizeable for causing pivotal movement of the wire drive armature means toward the electromagnetic means and opposite pivotal movement of radial inner portions of the wire drive armature means away from the wire drive magnetic means during movement from the non-print position to the print position in response to magnetic flux produced in the wire drive armature means; wire end bearing plate means for supporting the front print end portions of the longitudinally movable wire print means in closely spaced juxtaposition in substantially tangential relationship in a linear array; laterally shiftable support means for supporting the wire end bearing plate means and laterally movable between a first print position whereat the wire print means are selectively operable to print characters defined by a first set of adjacent, substantially tangential circularly shaped dots approximately equal in diameter to the diameter of front print end portions of the wire print means and a second print position whereat the wire print means are again selectively operable to repeat printing of the characters with a second set of overlapping circular dots which are offset from the first set of dots by approximately one half of the diameter of the first set of dots; selectively energizeable and de-energizeable motion inducing means operably associated with the laterally shiftable support means for selectively moving the laterally shiftable support means and the wire end bearing plate means between the first print position and the second print position.

The laterally shiftable support means comprises a one piece member made of molded plastic material located completely within the wire housing means and supported only by interior surfaces of the housing means. The support means has a polygonal peripheral configuration generally corresponding to the peripheral configuration of the inner surfaces of the housing means. A cavity is provided in the front surface of the support means to fixedly receive a conventional ruby bearing plate. A spring means is mounted between an inner surface of the housing means and the support means to enable the support means to be biased toward and normally held in one print position while also enabling the support means to be selectively moved to a second overlap print position against the bias of the spring means.

The motion inducing means comprises an elongated rigid plate-type armature member pivotally mounted completely within the housing means in a longitudinal attitude parallel to the longitudinal axis of the wire members and the wire housing means. A drive end portion of the armature member continuously operatively engages and supports the support means. The opposite other pivot end portion of the armature member is pivotally supported on the housing means. An elongated magnetic plate member is fixedly mounted on and within the housing means in parallel juxtaposition to the armature member. A pole end portion of the magnetic plate member is bifurcated to provide adjacent parallel pole portions. A wire coil means is located circumjacent one of the pole portions to selectively create a magnetic field effective to cause pivotal actuation of the armature member. The coil means is wound on a bobbin member having a pivot spring flange portion at one end which provides pivotal support means for the one end portion of the armature member. Another flange portion at the other end of the bobbin member supports a threaded adjustment means which is adjustably engageable with the other drive end portion of the armature member so that the amount of movement of the support means against the spring means may be adjustably varied as necessary or desirable to precisely control the amount of lateral displacement of the print end portions of the wire members.

The shiftable wire support means and the associated spring means are constructed and arranged to enable assembly into the wire housing cavity through a front wire outlet opening and supported therein by inner side surfaces of the wire housing means. Rigid guide and support means are provided by cooperating fixed surfaces on the shiftable support means and the wire housing means. In a first embodiment, the spring means comprises an elongated cantilever spring portion integral with the shiftable bearing support means which comprises a rigid front plate portion mounted on the front end of rigid elongated arm portions so as to enable rigid transverse arcuate movement along a very short arcuate distance (e.g., 0.007 inch) about a relative long length radius (e.g., 0.80 inch).

In a second embodiment of the invention, the shiftable wire support means is made of one piece of plate-like molded plastic material having a generally rectangular peripheral configuration with opposed parallel guide and support surfaces which are supportably slidably engageable with corresponding cooperable guide and support surfaces integrally formed on side wall portions of the wire housing means to enable linear lateral shifting movement. The spring means is a separate spring member such as a compression spring member located between the wire bearing support means and the housing wall opposite the drive end portion of the armature member.

The shiftable wire bearing support means may shiftably support a shiftable bearing means for all the wire members or a first shiftable bearing means for only some of the wire members with other wire members being mounted in a second non-shiftable bearing means located laterally adjacent the first shiftable bearing means.

In the second embodiment of the invention, the shiftable bearing support means and the wire housing means may be constructed and arranged to enable assembly and mounting of the shiftable bearing support means in the housing means by longitudinal inward movement through the print end wire opening at the print end portion of the wire housing. Cooperative lug means and slot means enable longitudinal inward and outward movement of the shiftable support means during assembly or disassembly to and from axial inward operating locations whereat the support and guide means on the shiftable bearing support means are laterally aligned with the support and guide means on the side wall portions of the housing means. At the operating location, the shiftable bearing plate support means is laterally displaceable to the normal print position whereat the lug means are located opposite abutment surface retaining means to prevent axial outward movement during normal operation in and between the normal print position and the overlap print position, the shiftable bearing plate support means being held in the normal assembled operating position by the armature member and being releasably axially movable during assembly or disassembly by outward displacement of the drive end portion of the armature member to provide sufficient clearance.

OBJECTS OF THE INVENTION

It is therefore an object of the present invention to provide an improved matrix print head output guide shifter.

Another object of the present invention is to provide an improved matrix print head output guide shifter which is simple in operation.

Another object of the present invention is to provide an improved matrix print head output guide shifter which is inexpensive to fabricate.

Another object of the present invention is to provide a matrix print head output guide shifter which is capable of producing high quality print.

Further objects of the invention are to provide shift apparatus which is located substantially completely within the confines of the wire housing; which may be assembled and disassembled through the front end portion opening of the wire housing; which comprises a minimum number of long lasting high efficiency low cost parts; which is operable at high speed with low power requirements; and which is easily and accurately adjustable.

Additional objects, advantages and novel features of the invention are set forth in part in the description which follows and will be understood by those skilled in the art upon examination of the following or may be learned by practice of the invention. The objects and advantages of the invention may be realized and obtained by means of the instrumentalities and combinations particularly pointed out in the specification and appended claims.

BRIEF DESCRIPTION OF THE DRAWINGS

An illustrative and presently preferred embodiment of the invention is shown in the accompanying drawings, wherein.

DETAILED DESCRIPTION OF THE PREFERRED EMBODIMENT OF THE INVENTION

Figures 1, 2:
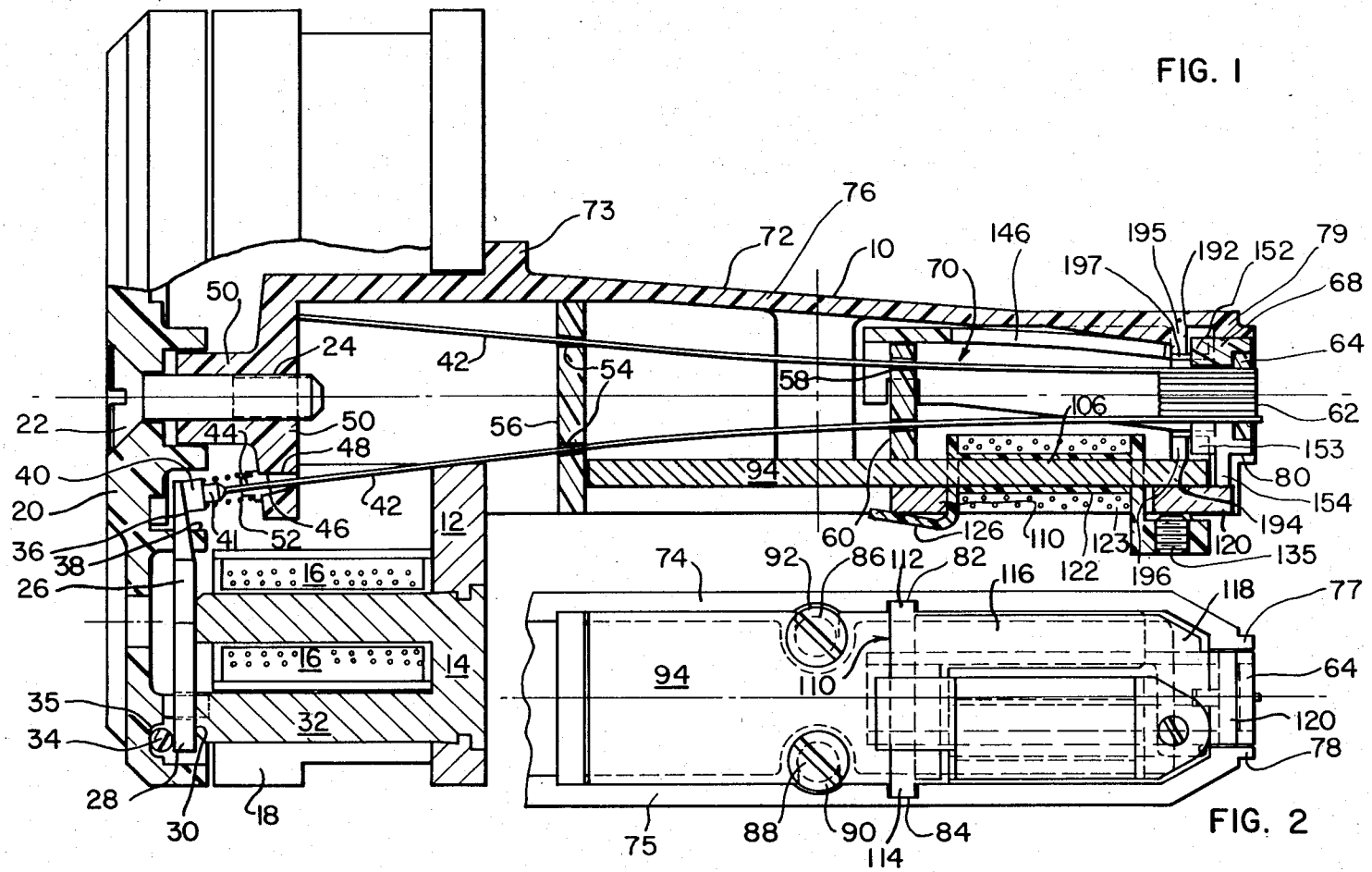
FIG. 1 is a side cut-away view of a first embodiment of the present invention.
FIG. 2 is a bottom view of the elongated wire housing portion of the device of FIG. 1.
Figure 3:
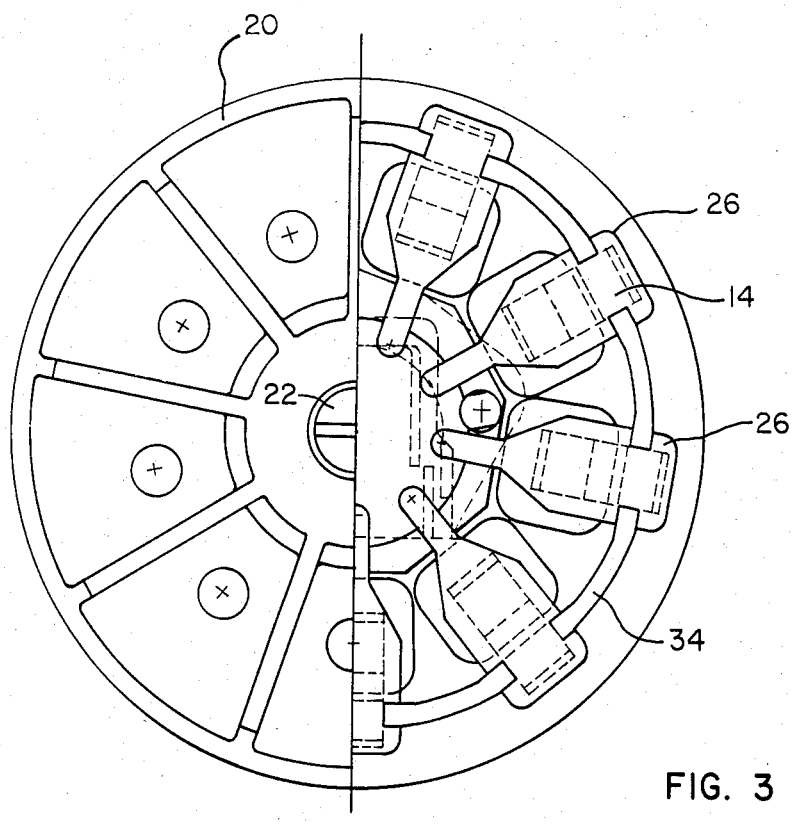
FIG. 3 is an end view of the rear end portion of device illustrated in FIG. 1.

Matrix wire printers are generally disclosed in U.S. Pat. Nos. 4,185,929, issued Jan. 29, 1980; 4,230,038, issued Oct. 28, 1980; and 4,230,412, issued Oct. 28, 1980, which are specifically incorporated herein by reference for all that they disclose. As generally illustrated in FIGS. 1–3, the wire print head assembly of the present invention comprises an elongated wire housing means 10 made of a single piece of any suitable relatively rigid molded reinforced high temperature plastic material. Magnetic support plate means 12 is mounted on a rear drive end portion of housing means 10 and supports a plurality of circumferentially spaced wire drive magnetic pole means 14. Wire drive magnetic coil means 16 are associated with each wire drive magnetic pole means 14 to induce magnetic flux in wire drive magnetic means 14. Annular outer sleeve means 18 is made of molded heat conductive plastic material and is mounted circumjacent the wire drive magnetic coil means to encapsulate the coil means and increase heat dissipation under high temperature applications.

Armature retaining cap means 20 is fixedly adjustably connected to housing means 10 by threaded connecting means 22, 24. Wire drive armature means 26 are mounted between retaining cap means 20 and wire drive magnetic means 14 for pivotal movement between a non-drive position and an energized print position. Outer end portions 28 of wire drive armature means 26 are resiliently pivotally held against outer surfaces 30 of outer pole portions 32 by armature spring means 34. Armature spring means 34 has the shape of an O-ring and is disposed in a groove 35 formed in retaining cap means 20. Inner end portions 36 of wire drive armature means 26 have inclined surfaces 38 for driving abutting engagement with wire end drive caps 40. Each of the wire end drive caps 40 is connected to the drive portions 41 of each of a plurality of longitudinally movable wire print members 42. Each wire print member extends forwardly through an associated guide bearing hole 44 in circumferentially spaced hub portions 45 of input guide means 46, as illustrated in FIG. 1. Input guide means 46 is mounted in conical shape openings 48 in hub portion 50 of housing means 10. A compression spring means 52 is mounted between each input guide means 46 and wire end drive caps 40. Each compression spring means 52 biases end drive caps 40 toward the non-print position while also resiliently deflectably holding guide hub portion 45 in openings 48 whereby each guide bearing hole 44 is individually self-alignable with the associated wires so that there will be uniform contact throughout the length of each hole. Wire print means 42 extend from hub portion 50 forwardly through associated circumferentially spaced openings 54 in rear guide plate means 56 and then through openings 58 in front guide plate means 60. The front print end portions 62 of longitudinally movable wire print means 42 are aligned in guide bearing holes formed in wire end bearing plate means 64, which can comprise a ruby or ceramic plate. Wire end bearing plate means 64 is mounted in laterally shiftable head portion 68 of support means 70. Head portion 68 is selectively laterally shiftable in a vertical direction between a first print position and a second overlap print position.

Housing means 10 comprises a single piece of molded plastic having an elongated neck portion 72 of U-shape cross-sectional configuration and a hub portion 50. Flange 73 is fixedly mounted on and abuttingly engages plate 12 upon application of pressure by suitable conventional threaded connecting means. Elongated neck portion 72 has spaced side wall portions 74, 75 and an upper connecting wall portion 76 which terminate in outer flange portions 77, 78, 79 which form an U-shaped outlet opening 80 in the front print end portion of the elongated neck portion 72. As illustrated in FIG. 2, elongated neck portion 72 contains slots 82, 84 for engagement with front guide plate means 60. Circular openings 86, 88 formed on side portions of the elongated neck portion 72 engage threaded connector means 90, 92. Threaded connector means 90, 92 fixedly secure an elongated magnetic plate 94 to the bottom portion of the elongated neck portion 72.

The shift apparatus is mounted in a front end portion of the cavity provided between the side wall portions and connecting wall portion of the wire housing means adjacent the wire outlet opening 79.

Figure 4:
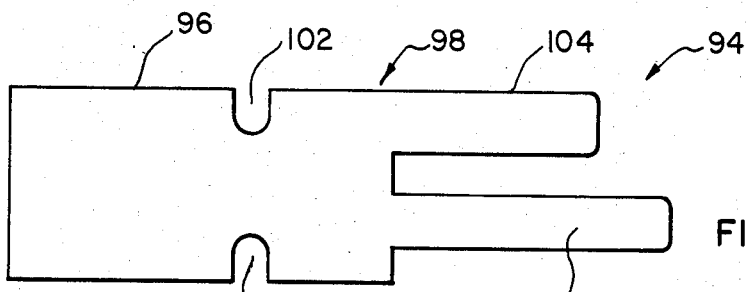
FIG. 4 is a reduced size bottom view of the magnet plate.
Figure 5:
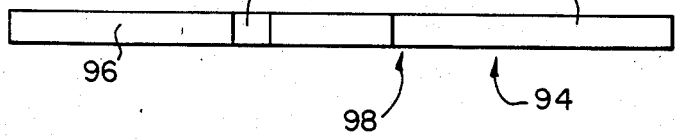
FIG. 5 is a reduced size side view of the magnet plate.

Each of the movable portions disposed in the front end of elongated neck portion 72 are illustrated in FIGS. 4 through 15. FIG. 4 is a bottom view of magnetic plate means 94. Magnetic plate means 94 comprises a rear rectangular portion 96 separated by notches 100, 102 from front portion 98 having a relatively short length pole portion 104 and a relatively long length pole portion 106. FIG. 5 is a side view of magnetic plate means 94 which illustrates that magnetic plate means 94 can be simply fabricated from a flat metal stamping. This greatly reduces the cost of manufacture.

Figure 6:
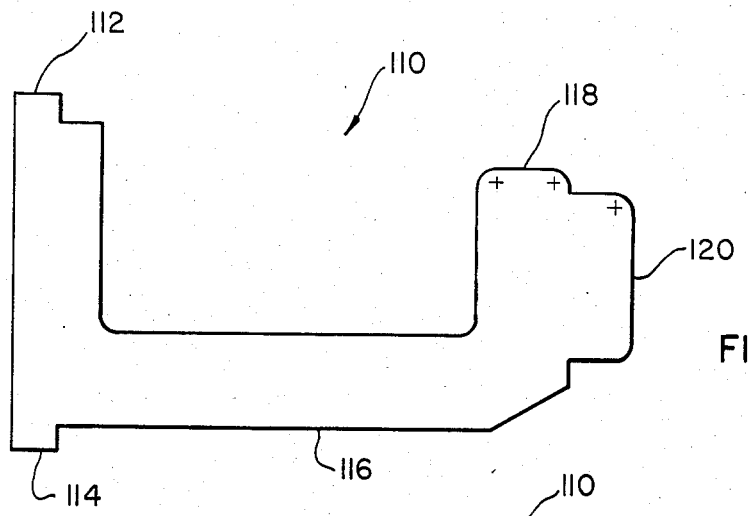
FIG. 6 is a reduced size top view of the shifter armature.
Figure 7:
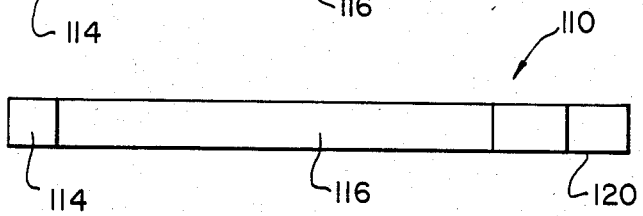
FIG. 7 is a reduced size side view of the shifter armature.

FIG. 6 is a top view of the shifter armature means 110. Shifter armature 110 has flange portions 112, 114 which are disposed in slots 82, 84 (FIG. 2) to hold the shifter armature 110 in place in housing means 10. Shifter armature 110 has an arm portion 116 which is connected to abutting neck portion 118 and abutting skirt portion 120. FIG. 7 is a side view of shifter armature 110. Shifter armature 110 can be fabricated from a flat metal stamping, in the same manner as magnetic plate means 94 as illustrated in FIGS. 6 and 7, so as to further reduce the cost of manufacture.

Figure 10:
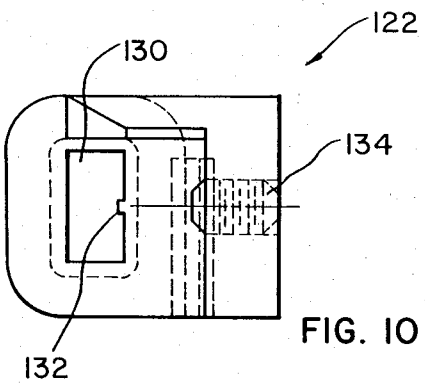
FIG. 10 is an end view of the shift magnet coil bobbin.
Figure 8:
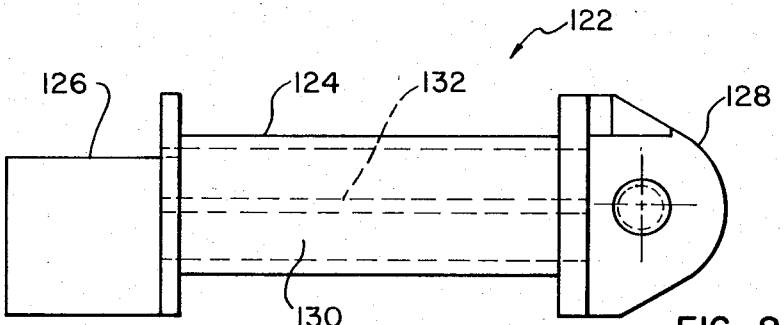
FIG. 8 is a top view of the shift magnet coil bobbin.
Figure 9:
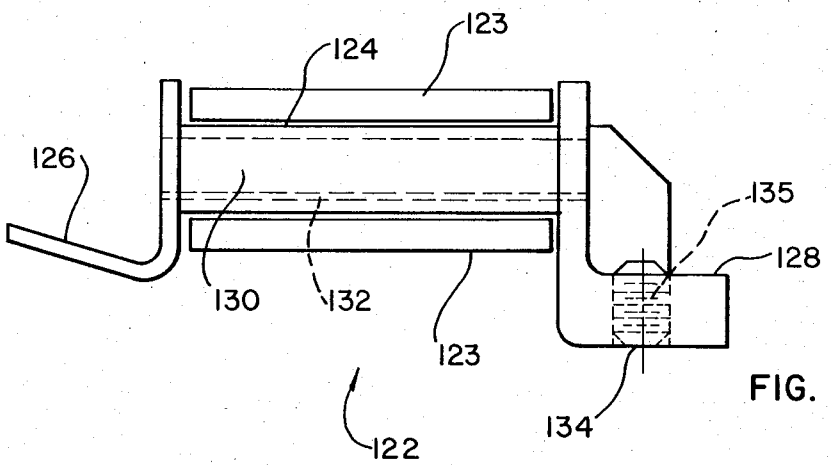
FIG. 9 is a side view of the shift magnet coil bobbin.

FIGS. 8 through 10 illustrate the shift magnet coil and bobbin means 122. The shift magnetic coil bobbin 122 is a high-strength, high-temperature resistant molded plastic part which functions as a bobbin for the shift magnetic coil 123. FIG. 8 is a top view of shift magnet coil bobbin 122 illustrating a central body portion 124, an armature biasing spring-pivot flange portion 126, and an armature adjustment head portion 128. Opening 130 extends through the length of the body portion 124 and through head portion 128 and biasing spring portion 126. A rib portion 132 is formed in opening 130 and provides interference with pole 106 of plate 94 for precisely and rigidly securing bobbin 122 on said pole.

As shown in FIGS. 9 and 10, a threaded opening 134 is formed in head portion 128 and is adapted to accept adjustment screw 135. Elongated pole portion 106 of magnetic plate means 94 is disposed through opening 130 in shift magnet coil bobbin 122. The electromagnet means is of highly efficient low reluctance design which may operate with less than 100 ampere turns and 0.50 watts at continuous duty.

Figure 13:
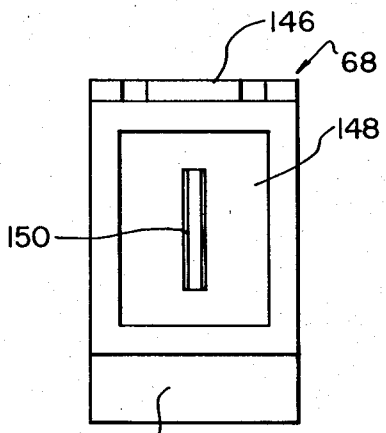
FIG. 13 is an end view of the shiftable support means.
Figure 11:
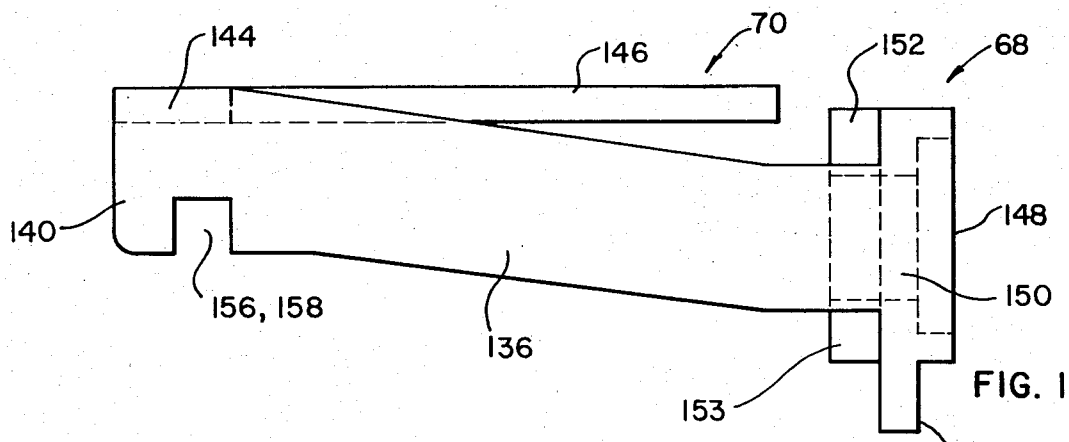
FIG. 11 is a side view of the shiftable bearing plate support means.
Figure 12:
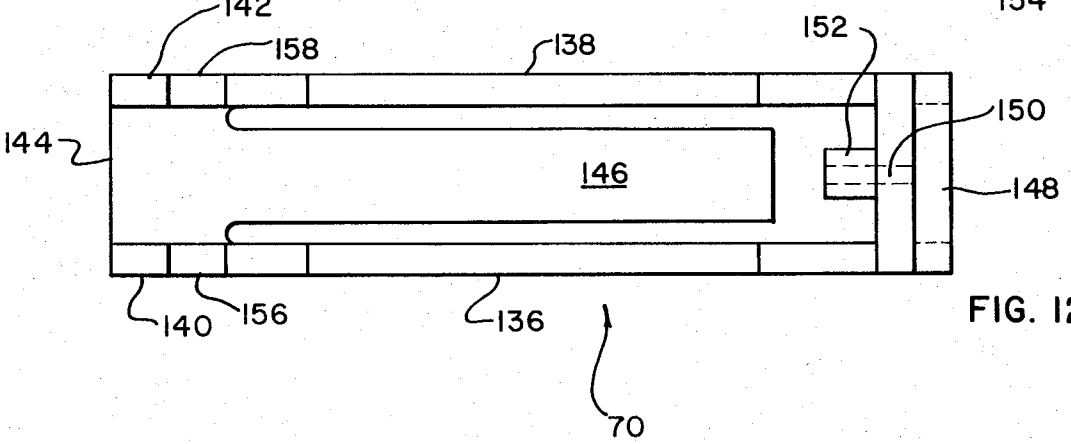
FIG. 12 is a bottom view of the shiftable support means.

FIGS. 11 through 13 illustrate the shiftable wire bearing plate support means 70 which has a head portion 68 connected to and supported in cantilever fashion at one end of a pair of spaced leg portions 136, 138. Spaced leg portions 136, 138 are connected at the other end to a pair of spaced sidewall portions 140, 142 which are connected by an intermediate connecting portion 144. Intermediate connecting portion 144 is connected to resilient spring finger portion 146 which functions as a cantilever spring with regard to spaced leg portions 136, 138 to enable a slight amount of pivotal displacement of head portion 68 which has cavity means 148 adapted to accept wire end bearing plate means 64. Wire slot means 150 extends through head portion 68, including key portions 152, 153 which function to align head portion 68 in a vertical direction in the wire housing means as illustrated in FIG. 1. Abutment flange means 154 is connected to the lower portion of housing portion 68 and engages the upper surface of the drive end portion of armature 110. Notches 156, 158 are formed in sidewall portions 140, 142 and function to hold shiftable support means 70 in position in housing means 10 by engagement with front guide plate means 60. Notches 156, 158 serve as a pivot point for movement of housing means 68 in a vertical direction against the bias of spring arm portion 146 which abuts the upper inner wire housing surface as shown in FIG. 1.

Figure 14:
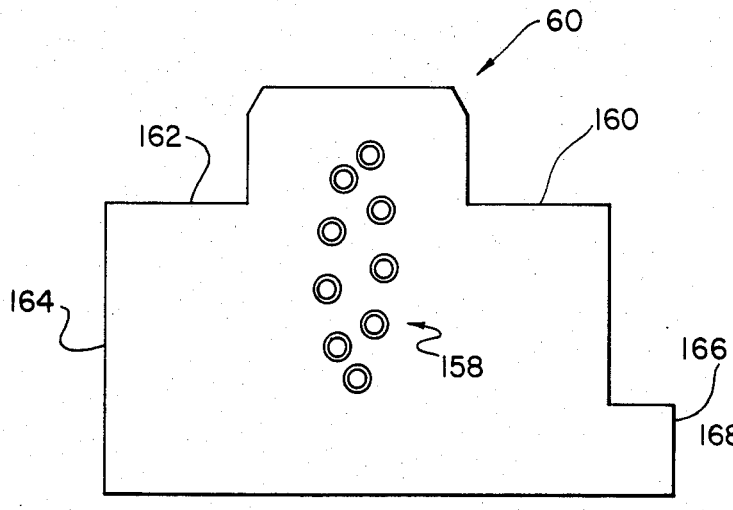
FIG. 14 is an end view of the front guide plate means.
Figure 15:
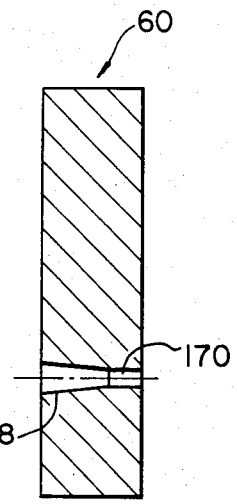
FIG. 15 is a side view of the front guide plate means.

FIGS. 14 and 15 illustrate guide plate means 60. FIG. 14 is an end view of front guide plate 60 illustrating wire bearing holes 158 located in a non-linear array with each hole having a portion adapted to reciprocally support an intermediate portion of said longitudinally movable wire print means 42. Abutment surfaces 160, 162 engage notches 156, 158 (FIGS. 11 and 12) formed in sidewall portions 140, 142 of pivotally shiftable support means 70. Side portions 164, 166 of front guide plate means 60 engage slots 82, 84 in housing means 10 (FIG. 1) to secure front guide plate means 60 in housing means 10.

As illustrated in FIG. 15, wire bearing holes 158 have a tapered portion 168 which guide the longitudinally movable wire print means 42 through wire bearing holes 158 during assembly. Cylindrical portions 170 provide bearing means to maintain the longitudinally movable wire print means 42 in proper position to prevent transverse movement during operation.

Figure 16:
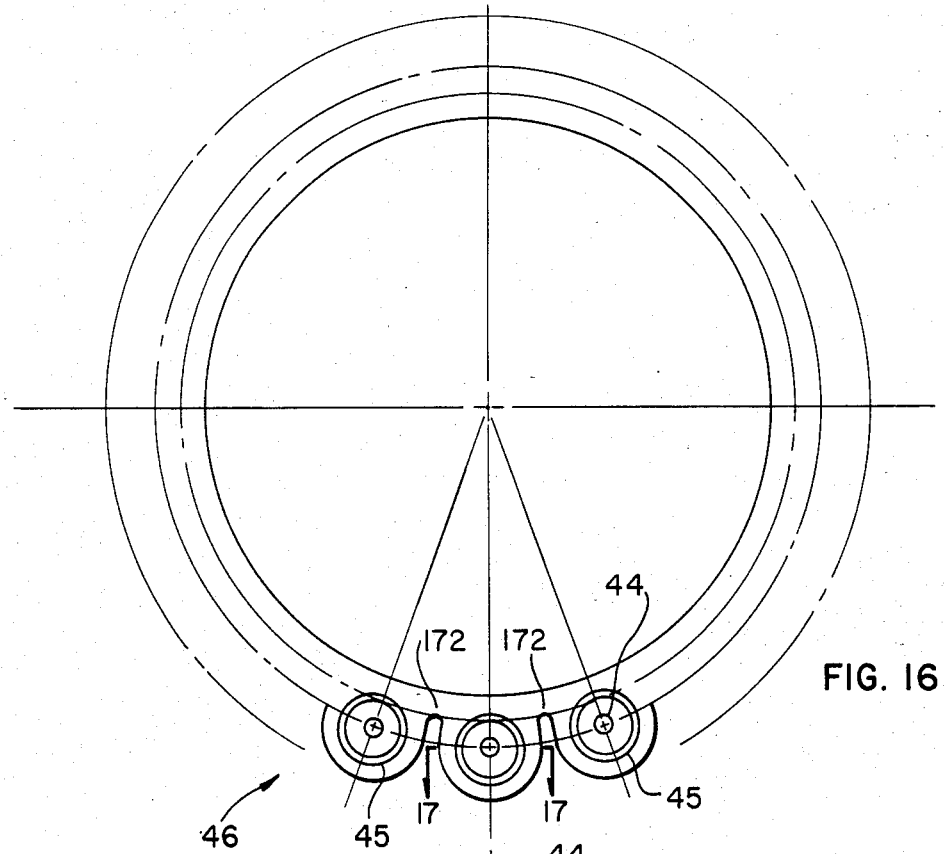
FIG. 16 is an end view of the input guide.
Figure 17:
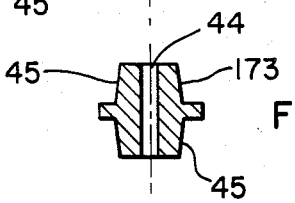
FIG. 17 is a cut-away view of an individual guide member.

FIG. 16 is an end view of input guide means 46. Input guide means 46 comprises a single annular ring shape piece of molded plastic having a plurality of guide hub portions 45 connected by relatively thin flexible flange portions. As illustrated in FIG. 17, each of the hub portions 45 has a conical shape portion 173 fabricated to align with guide bearing holes 44 in hub portion 50 of housing means 10 and separated from a spring support portion by an abutment flange portion. Fabrication of input guide means 46 in a single molded plastic piece of this construction allows guide members 172 to be assembled and replaced in a simple and easy manner while enabling individual alignment of each hub portion with each wire member.

Figure 18:
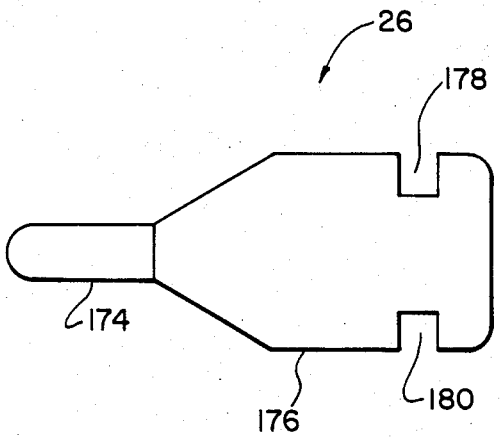
FIG. 18 is an end view of the wire drive armature.
Figure 19:
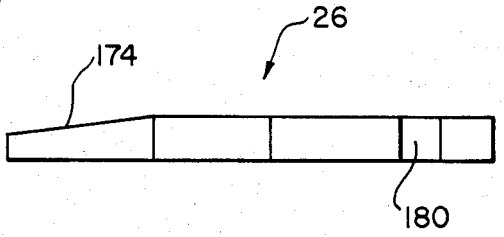
FIG. 19 is a side view of the wire drive armature.

FIGS. 18 and 19 illustrate wire drive armature means 26. FIG. 18 is an end view of wire drive armature means 26 illustrating inclined drive portion 174, main body portion 176, and notches 178, 180. Inclined drive portion 174 is clearly illustrated in FIG. 19. Notches 178, 180 engage armature bearing means 34 as illustrated in FIG. 3. The operation of the apparatus is generally described in my prior United States patents referenced above.

Figure 20:
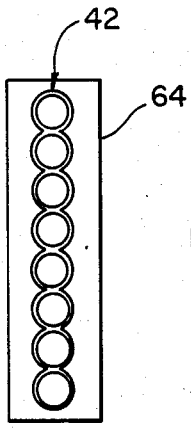
FIG. 20 is an end view of the wire end bearing plate.

FIG. 20 is an end view of wire end bearing plate means 64 illustrating longitudinally movable wire print means 42 mounted therein. Wire end bearing plate means 64 positions longitudinally movable wire print means 42 in closely spaced juxtaposition in a substantially tangential relationship in a linear array. This produces an ink imprintation in a conventional manner upon actuation of all of the longitudinally movable wire print means 42 such as illustrated in FIG. 21.

Figure 21:
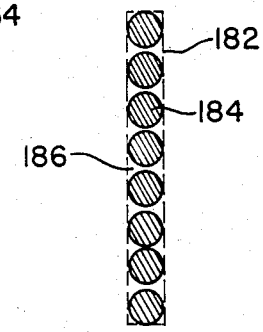
FIG. 21 illustrates the imprintation zone of a single imprintation.

FIG. 21 illustrates the print zone 182 in which a linear array of circular imprintations 184 are produced during a single imprintation process. As illustrated in FIG. 21, void portions 186 reduce the quality of print provided by the linear array of the circular imprintations 184 produced during a single imprintation process.

Figure 22:
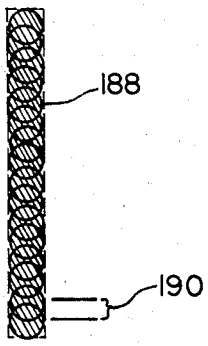
FIG. 22 illustrates the imprintation produced after a repeat imprintation.

FIG. 22 illustrates the linear array of circular imprintations 188 provided by the present invention after a repeat printing process in which housing portion 68 of linearly shiftable support means 70 has been shifted in a vertical direction by an amount 190 which is one half of the diameter of the longitudinally movable wire print means 42. This process eliminates the void portions 186, as illustrated in FIG. 21, and provides a much higher quality of print after the repeat printing process.

ASSEMBLY

Shiftable support means 70 is initially inserted in housing means 10 through rectangularly shaped opening 80 formed in the front portion of housing means 10 with guide flange portions 152, 153, located in cooperating guide notches 192, 194 in transverse rib portions 195, 196 of housing means 10 which define a rectangular-shaped opening 197. Wire end bearing means 64 is mounted and bonded into cavity means 148 on head portion 68. Front guide plate means 60 is then inserted into slots 82, 84 formed in housing means 10 and into free engagement with notches 156, 158 formed in shiftable support means 70. Longitudinally movable wire print means 42 is then inserted through wire end bearing plate means 64. Subsequently, magnetic plate means 94, shifter armature 110 and shift magnetic coil bobbin 122 are assembled and inserted in housing means 10. Threaded connectors 90, 92 then secure magnetic plate means 94 to the bottom portion of housing means 10. Upon tightening threaded connector means 90, 92, shifter armature 110 and shift magnetic coil bobbin 122 become properly positioned relative to magnetic plate means 94. Resilient spring finger portion 126 of bobbin means 122 engages the rear end portion of the shifter armature 110 and is deflected downwardly thereby while providing a pivotal support therefor.

OPERATION

Figure 23:
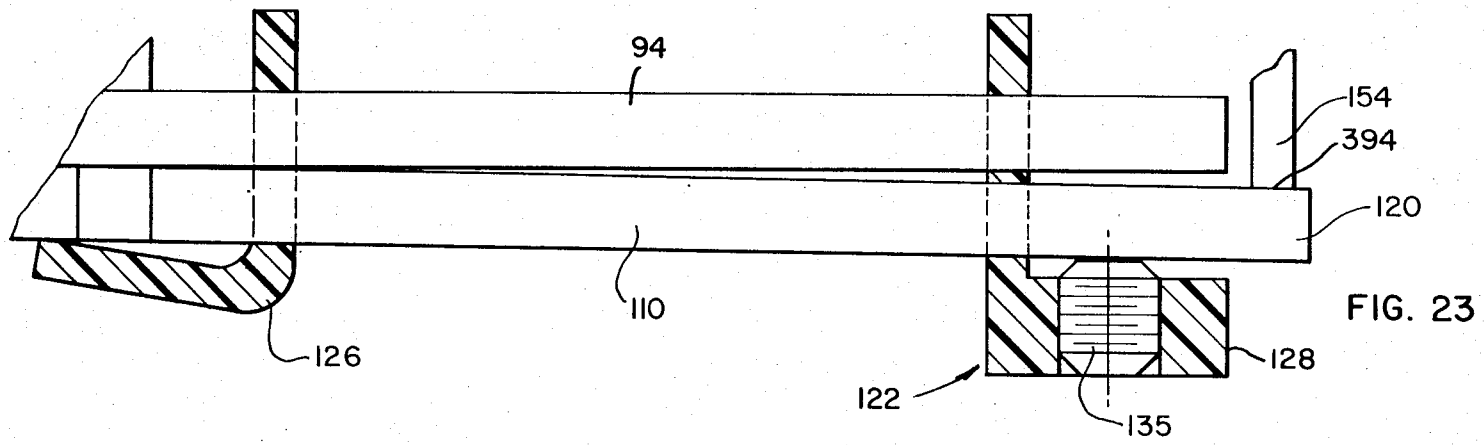
FIG. 23 is a schematic illustration of the present invention in the non-energized first print position.
Figure 24:
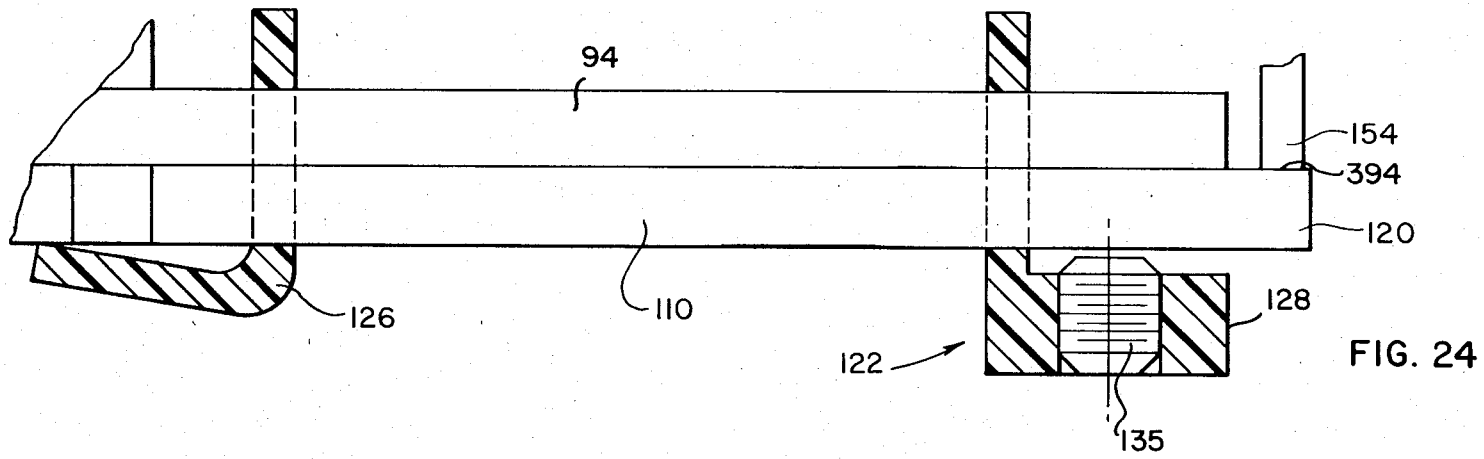
FIG. 24 is a schematic illustration of the present invention in the energized second print position.

High quality print such as disclosed in FIG. 22 is achieved in accordance with the present invention by slight pivotal movement of head portion 68 of shiftable support means 70 between a first print position and a second print position. Abutting skirt portion 120 of shifter armature 110 is located in continuous abutting engagement with abutting flange means 154 of shiftable support means 70 as illustrated in FIGS. 23 and 24. Shifter armature 110 is pivotally movable between a non-energized position as illustrated in FIG. 23, at which the shiftable head portion 68 is located in the first printing position, and in energized position, as illustrated in FIG. 24, at which head portion 68 is located in a second overlap print print position. Head portion 68 is operably connected to resilient spring finger portion 146 which biases head portion 68 towards the first print position and the shifter armature 110 towards the non-energized position. When shift magnet coil 123 is energized, shifter armature 110 moves to an energized position (FIG. 24) and moves head portion 68 to the second overlap print position against the bias of resilient spring finger portion 146. Shifter armature 110 pivots on biasing spring 126 between the energized position and non-energized position. When shift magnet coil 123 is deenergized, resilient spring finger portion 146, which continuously engages upper inner surface portions of wire housing 72 as shown in FIG. 1, provides a sufficient downward force to move head portion 68 to the first print position and shifter armature 110 to the deenergized position. Shift magnet coil 123 is mounted on shift magnet coil bobbin 122 and generates flux in elongated pole portion 106 of magnetic plate means 94 which extends through opening 130 in shift magnet coil bobbin 122. This causes a flow of magnetic flux through both short pole portion 104 and elongated pole portion 106 of magnetic plate means 94 to generate a magnetic force which attracts shifter armature 110 towards magnetic plate means 94 in an upward direction. Biasing spring 126 of shift magnet coil bobbin 122 is engageable with the pivot end portion of shifter armature 110 and functions as a retainer spring for shifter armature 110. Armature adjustment screw 135 in head portion 128 is engageable with abutting neck portion 118 of shifter armature 110 to allow shiftable head portion 68 to be properly adjustably located in the first print position.

Figure 25:
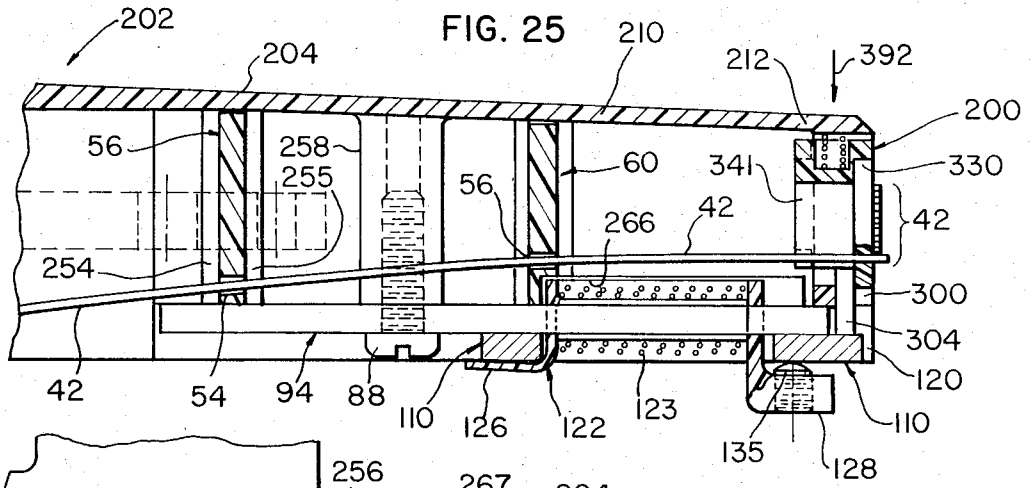
FIG. 25 is a cross-sectional side elevational view of a modification of the wire housing and wire shift apparatus of the print head assembly of FIG. 1.
Figure 26:
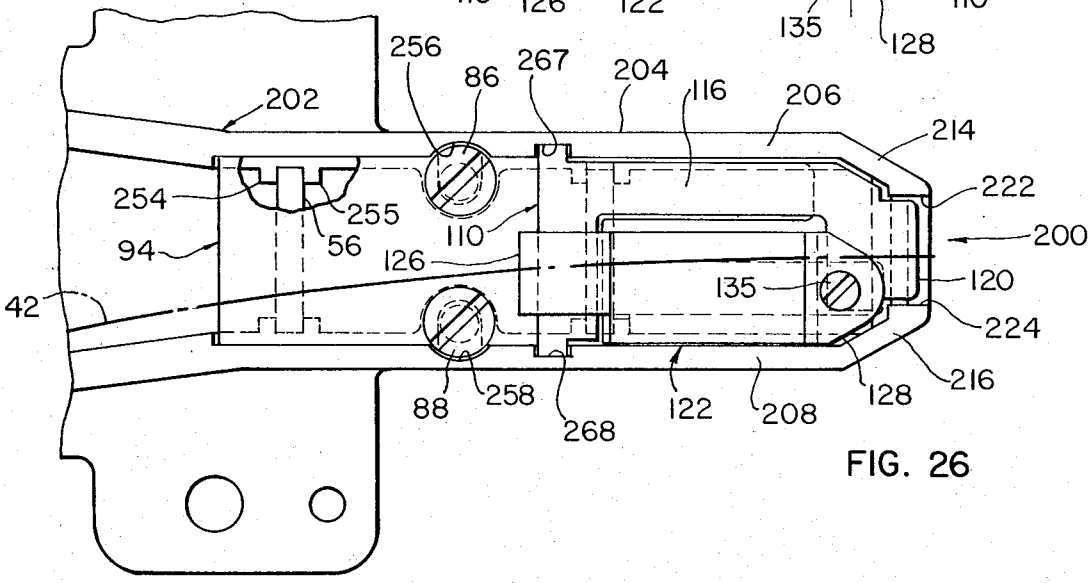
FIG. 26 is a bottom view of the apparatus of FIG. 25.
Figure 26A:
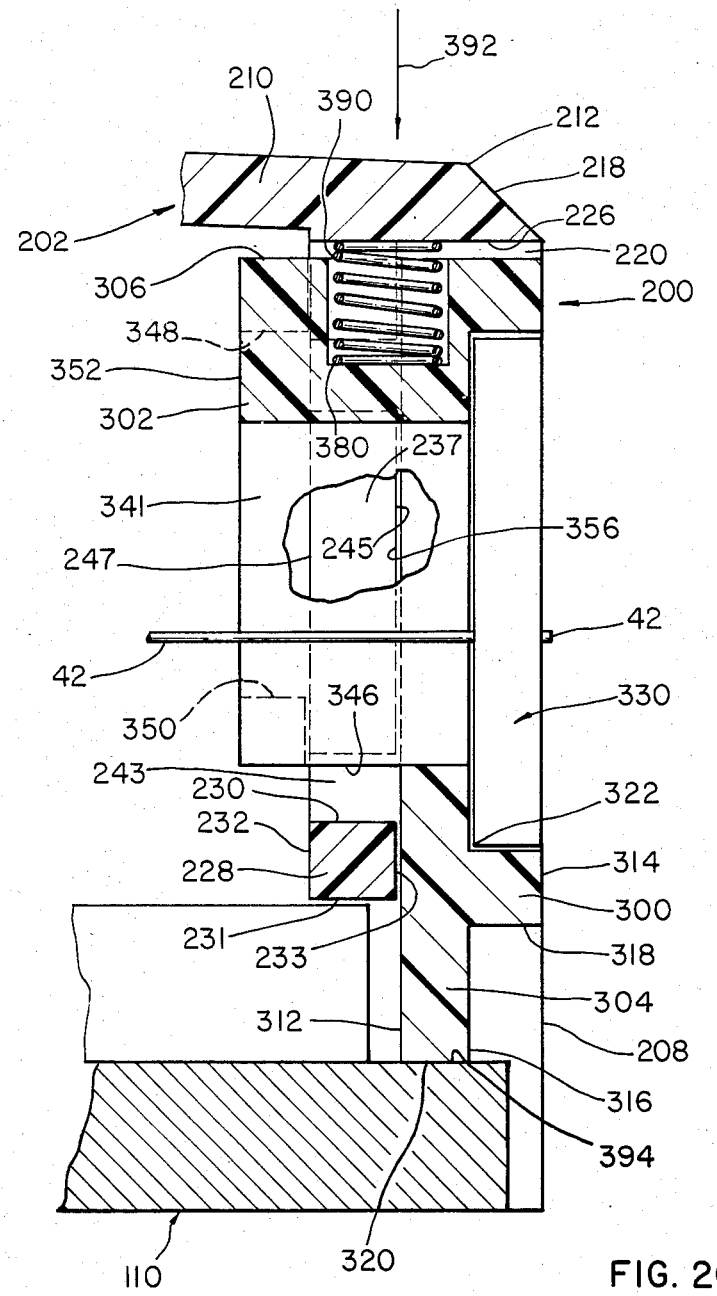
FIG. 26A is a cross-sectional view of a portion of the apparatus of FIG. 25.

FIGS. 25, 26 and 26A show a modification of the linearly shiftable bearing plate support means 68, 70 and the wire housing means 10 of FIGS. 1–24 wherein a relatively short-length, small-size one-piece linearly shiftable bearing plate support means 200 is provided with integral guide-retaining means cooperable with integral guide-retaining means on housing means 202 to enable axial inward insertion of the support means 200 through an opening in the nose portion of housing means to an assembled portion and thereafter enable transverse linear shifting movement during operation. The construction and arrangement of the other components including magnetic plate-pole means 94, armature means 110 and bobbin-coil means 122 are essentially the same as previously described.

Figure 27:
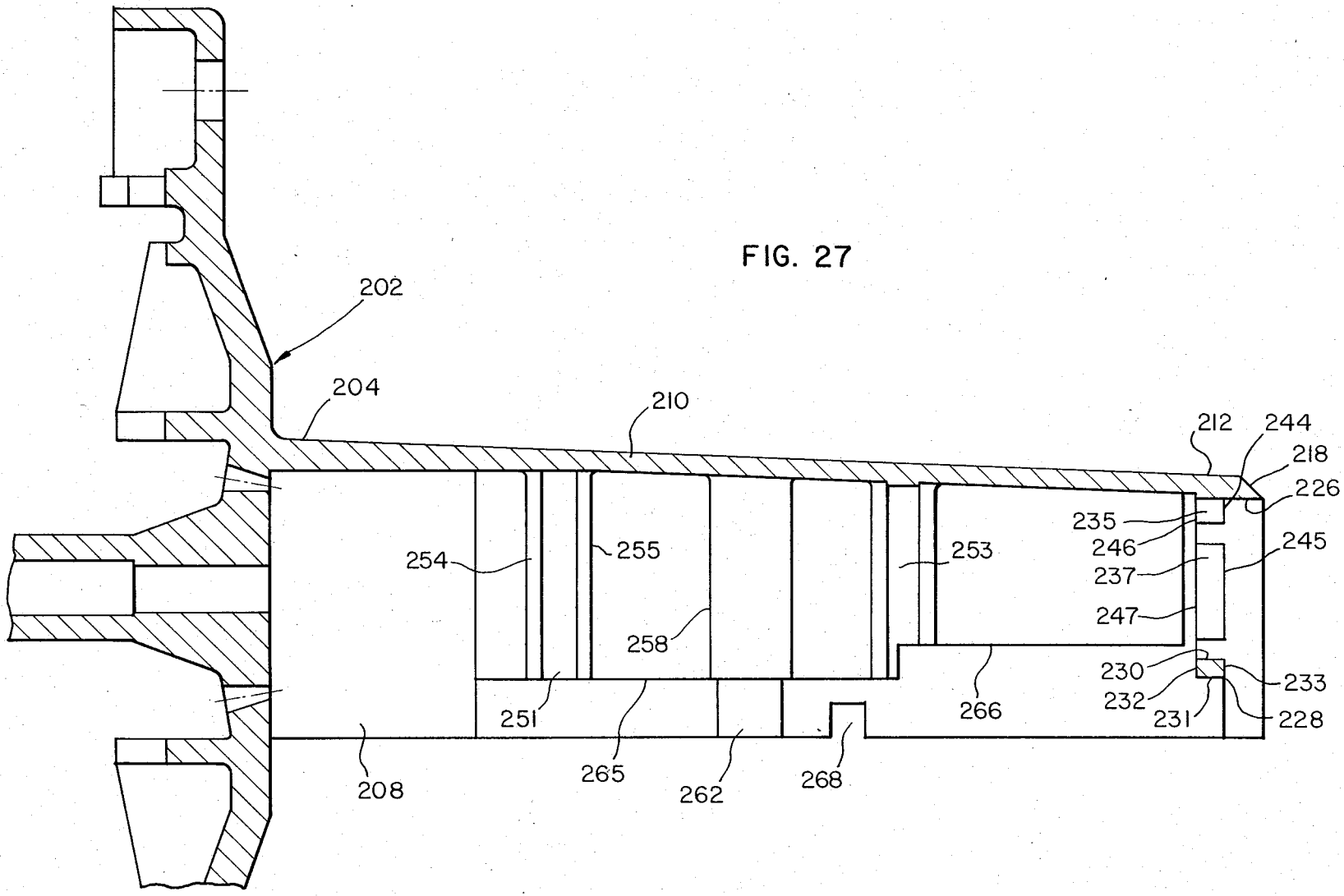
FIG. 27 is a cross-sectional side elevational view of the print end portion of the wire housing of FIG. 25.
Figure 28:
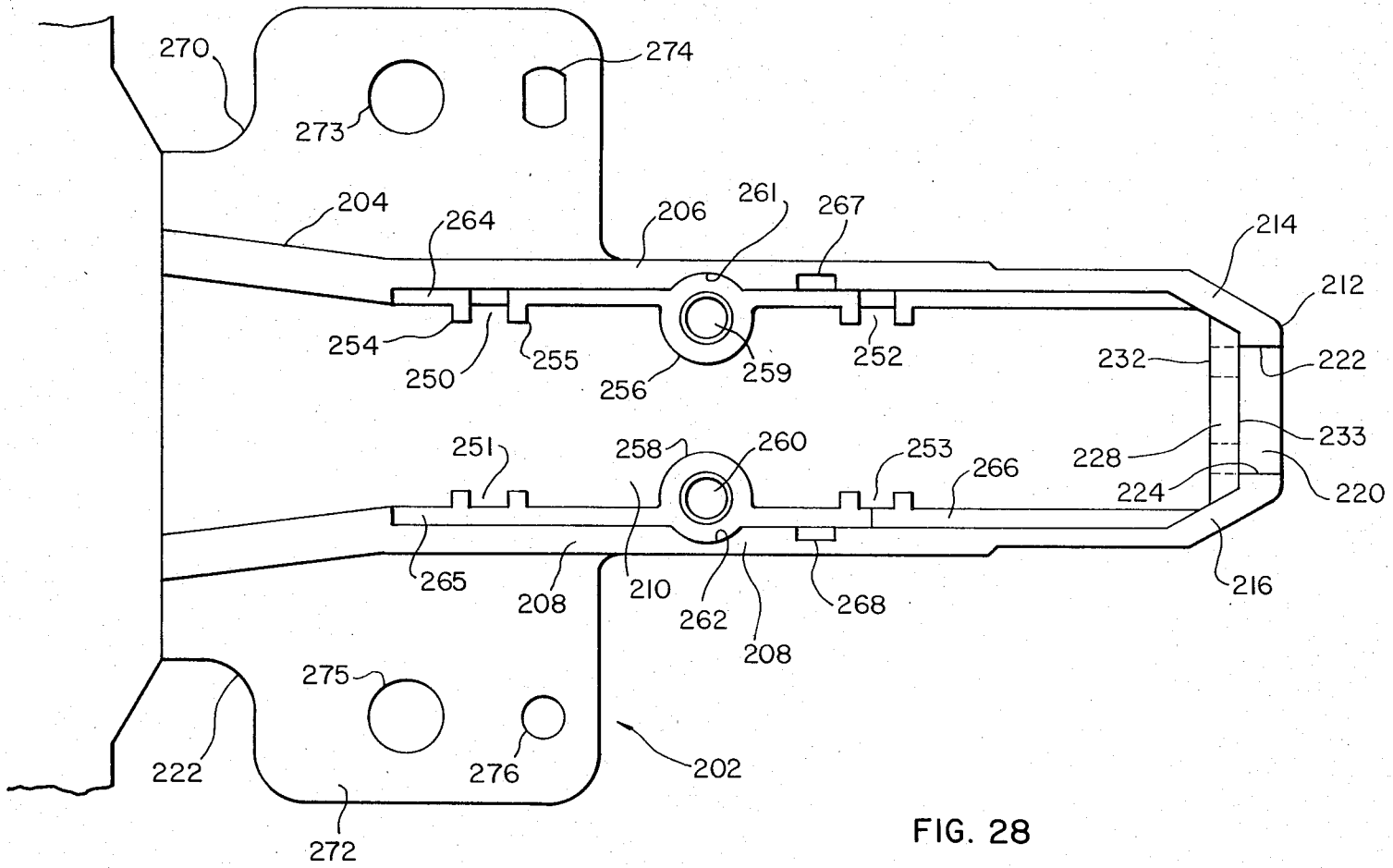
FIG. 28 is a bottom view of the wire housing portion of FIG. 27.
Figure 29:
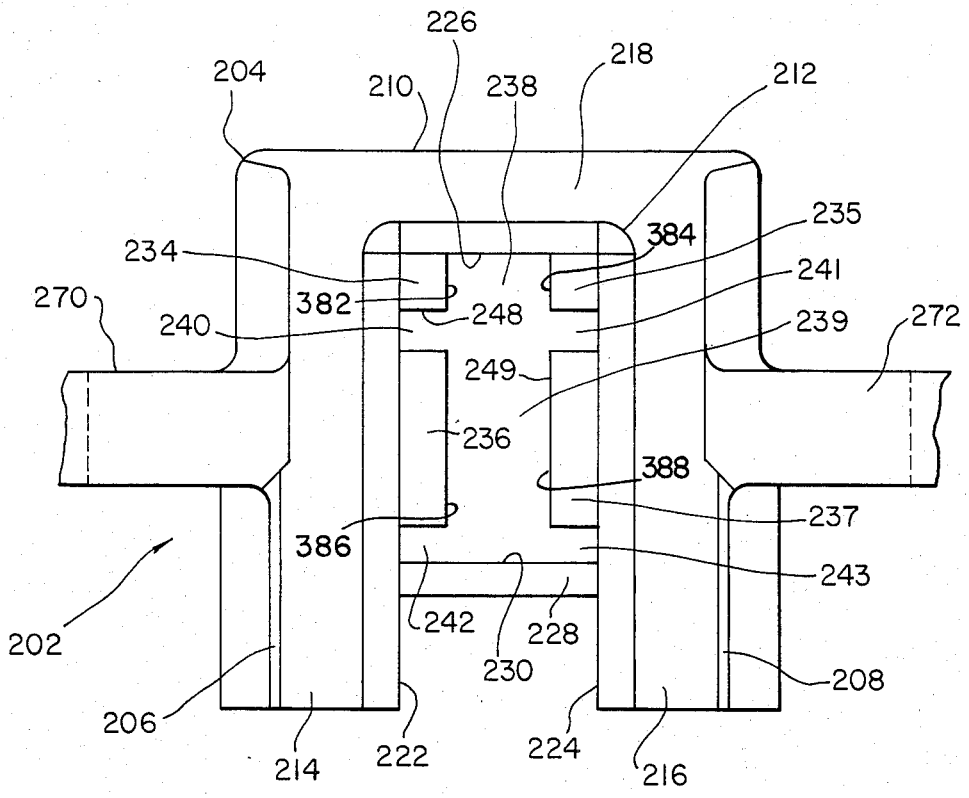
FIG. 29 is an end view of the wire housing portion of FIG. 28.

Housing means 202 is preferably made of one-piece of precision molded plastic material such as LNP EFL 4036-15% PTFE LUBED 30% GLASS FIBRE FILLED POLYETHERIMIDE. As shown in FIGS. 27–29, wire guide housing portion 204 has a generally U-shaped cross-sectional configuration defined by spaced, generally parallel, elongated side wall portions 206,208 and a connecting wall portion 210. Wall portions 206, 208, 210 terminate in a nose portion 212 having inwardly inclined side wall portions 214, 216 and an inclined connecting portion 218 defining an U-shape opening 220 having spaced parallel side wall surfaces 222, 224 and a connecting side wall surface 226. An integral rib portion 228 of polygonal cross-sectional configuration extending across opening 220 between opposite side wall portions 214, 216 is defined by flat surfaces 230, 231, 232, 233. Opposite pairs of aligned flange portions 234, 235 and 236, 237 integral with side wall portions 214, 216 are separated from one another by aligned polygonal central slots 238, 239 and aligned side slots 240, 241. Flange portions 236, 237 are separated from rib portion 228 by aligned opposite side slots 242, 243. Side slots 240, 241, 242, 243 have the same size and shape. The rear and front side surfaces 244, 245, 246, 247, FIG. 27, of the flange portions are coplanar with rib side surfaces 232, 233. Each of the pairs of lateral opposite aligned side surfaces (e.g. 248, 249) of each of the flange portions 234, 235, 236, 237 are also coplanar and are parallel to housing surface 226 and rib surface 230 as illustrated in FIG. 29. The side surfaces 244–247 are constructed and arranged to provide retaining means and guide means for shiftable bearing plate support means 200 as hereinafter described.

Housing means 202, FIG. 28, further comprises opposite aligned pairs of slots 250, 251, 252, 253 integrally formed in side wall portions 206, 208 by parallel spaced rib portions 254, 255 to provide guide and retaining means for intermediate wire guide-bearing plate means 56, 60, FIGS. 25 & 26. A pair of oppositely spaced rib portions 256, 258, FIG. 28, of generally semi-circular cross-sectional configuration are integrally formed in side wall portions 206, 208 and have threaded fastener holes 259, 260 to receive threaded fastener means 86, 88, FIG. 26. Side wall portions 206, 208 have relieved curved portions 261, 262, FIG. 28, to accommodate the head portions of the threaded fastener means. A shelf-type support means is provided for magnetic plate means 94 by inwardly offset opposite parallel coplanar surfaces 264, 265 on side wall portions 206, 208. Clearance for bobbin-coil means 122 is provided by a further inwardly offset surface 266 on side wall portion 208. Armature support and locating means are provided by a pair of oppositely spaced notches 267, 268 in side wall portions 206, 208. Print head mounting means are provided by a pair of oppositely spaced flange portions 270, 272 having suitable openings 273, 274, 275, 276 for attachment to the operating mechanism (not shown) of a printer apparatus (not shown) on which the print head is mounted in use.

Figure 34:
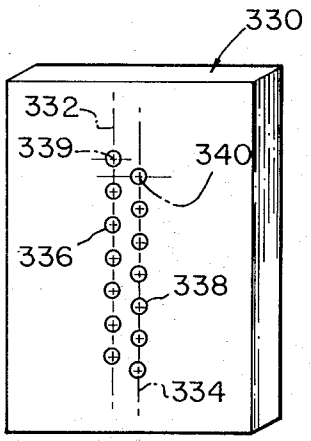
FIG. 34 is a front view of a bearing plate member.
Figure 33:
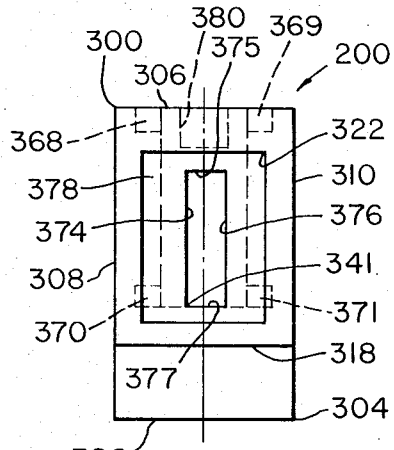
FIG. 33 is a front end view of the support means of FIG. 30.
Figure 30:
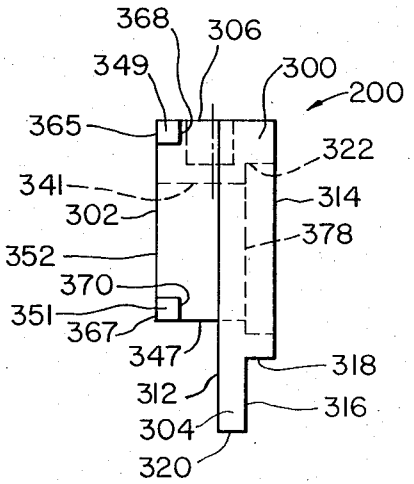
FIG. 30 is a side elevational view of the shiftable bearing plate support means of the apparatus of FIGS. 25 & 26.

The shiftable bearing plate support means 200 is made of one piece of molded plastic material such as nylon with 30% glass fibers, 13% PTFE and 2% silicone (by weight). As shown in FIGS. 30–33, bearing plate support means 200 comprises a relatively wide front plate portion 300 having a centrally located relatively narrow rib portion 302 extending rearwardly therefrom, and a lower flange portion 304 extending downwardly therefrom. Portions 300 and 302 have a common flat upper surface 306. Portions 300 and 304 have common flat parallel opposite side surfaces 308, 310 and a common flat lower rear surface 312. Front surface 314 of portion 300 is offset from front surface 316 of portion 304 and connected thereto by a rearwardly extending surface 318 which is parallel to bottom surface 320 of flange portion 304. A mounting means for a wire end bearing plate is provided in portion 300 by a rectangular slot 322 which fixedly receives a ceramic or ruby type guide plate means 330, FIG. 34, having parallel offset rows 332, 334 of wire bearing holes 336, 338. The centers 339 of wire holes 336 in row 332 are laterally offset by one-half the wire diameter from the centers 340 of wire holes 338 in row 334 and slidably receive the print end portions of print wire members 42, FIG. 33. A rectangular narrow width wire slot 341 extends through portions 300, 302 and opens centrally in plate slot 322 in alignment with wire bearing holes 336, 338. Rib portion 302 has a rectangular cross-sectional configuration defined by parallel opposite side surfaces 342, 344 and spaced coplanar bottom surfaces 346, 347 parallel to top surface 306 and located on opposite sides of slot 341 to provide clearance for the bottom wire members 42. Square shape lug portions 348, 349, 350, 351 are provided at the rear corners of rib portion 302 in adjacent coplanar relationship with rear surface 352 and top and bottom surfaces 306, 346, 347. Rib portion 302 divides rear surface 312 of front plate portion 300 into a pair of coplanar rearwardly facing rear side surfaces 354, 356. The lug portions 348, 349 & 350, 351 have coplanar laterally facing side surfaces 360, 361, 362, 363, which are parallel to rib portion side surfaces 342, 344, and coplanar forwardly facing side surfaces 364, 365, 366, 367 which are parallel to rearwardly facing front plate side surfaces 354, 356. Lug surfaces 368 and 369 and 370, 371 are coplanar and parallel to side surfaces 352 and 346, 347, respectively. The side surfaces 374, 375, 376, 377 of guide plate slot 322 are parallel with lug surfaces 360, 361, 362, 363, rib portion surfaces 342, 344 and plate portion surfaces 308, 310. The rear bottom surface 378 of guide plate slot 322 is parallel with plate portion rear side surfaces 354, 356 and lug portion front side surfaces 364, 365, 366, 367. An upwardly opening circular spring cavity 380 is centrally located in upper surface 306 within front portion 300 and rear rib portion 302.

The construction and arrangement of shiftable bearing plate support means 200 is such as to provide a peripheral configuration generally corresponding to the peripheral configuration of housing opening 220, flange portions 234, 235, 236, 237 and slot portions 240, 241, 242, 243.

Figure 31:
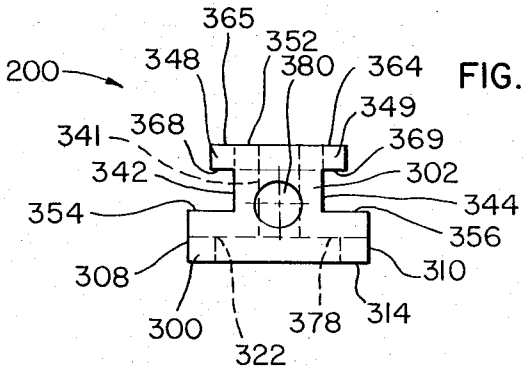
FIG. 31 is a top view of the support means of FIG. 30.
Figure 32:
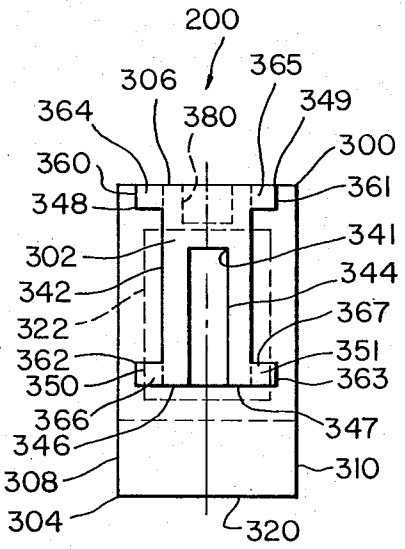
FIG. 32 is a rear end view of the support means of FIG. 30.
Figure 35:
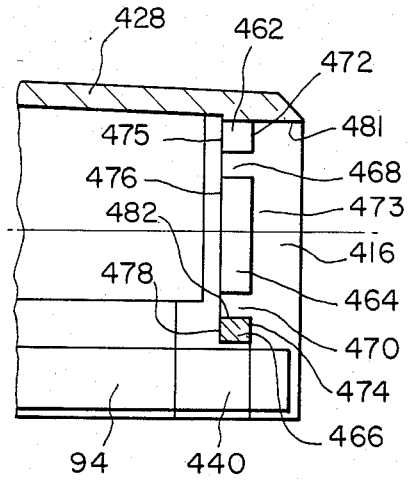
FIG. 35 is a cross-sectional side elevational view of the wire housing print end portion of an alternative embodiment of the invention shown in FIGS. 25 & 26.
Figure 37:
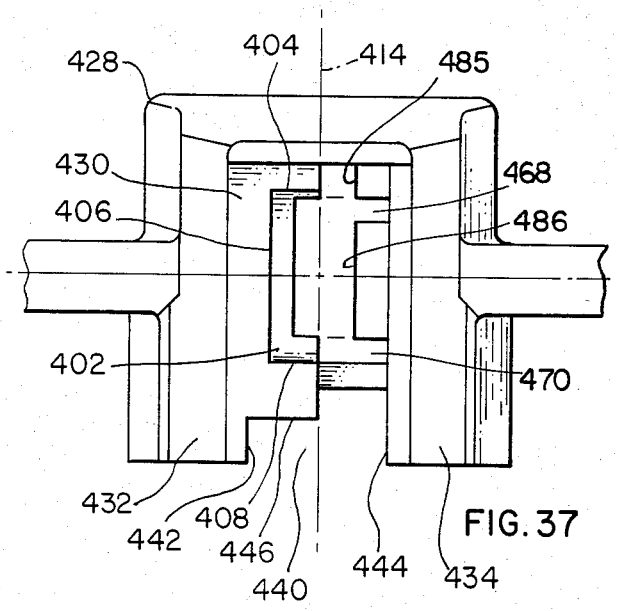
FIG. 37 is a front end view of the wire housing portion of FIG. 36 with wire and bearing plate means mounted therein.
Figure 36:
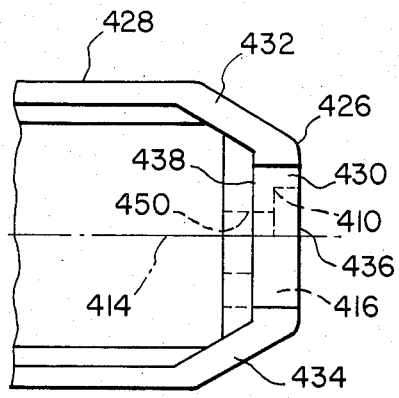
FIG. 36 is a bottom view of the wire housing portion of FIG. 35.

The height and width (e.g.0.040 inch) of slots 240, 241 242, 243, FIG. 29, is substantially larger (e.g. 0.010 inch) than the length and width (e.g. 0.030 inch) of lugs 348, 349, 350, 351, FIG. 32, to enable free sliding axial inward passage of the lugs therethrough during assembly. In addition, the width (e.g. 0.114 inch) of rib portion 302 between side surfaces 342, 344, FIG. 31, is substantially smaller (e.g. 0.006 inch) than the width (e.g. 0.120 inch) between flange surfaces 382, 384 and 386 & 388, FIG. 29, to enable free sliding axial passage during assembly and friction free non-abutting movement during operation.

When the bearing plate support means 200 is mounted in the housing means 202, a compression spring 390, FIG. 25, is mounted in spring cavity 380 with the upper end portion seated against housing surface 226 to exert a biasing force in the direction of arrow 392 on support means 200 to hold bottom surface 320 in abutting engagement with the upper armature end surface 394. Mounting means 200 is assembled by axial inward movement through housing opening 220 with the armature 110 removed or in a downwardly displaced position. During inward sliding movement, rib surface 346 is supported on rib surface 230. Lug portions 348, 349, 350, 351 are aligned with slots 240, 241, 242, 243 and pass therethrough. Side surfaces 342, 344 on rio portion 302 pass between side surfaces 382, 384, 386, 388 of flange portions 234, 235, 236, 237 until rear side surface 312 of flange portion 304 abuts front side surface 233 of housing rib portion 228. In this position, support means 200 may be freely moved laterally upwardly against the bias of spring 390 by engagement of armature surface 394, FIG. 26A, with flange surface 320 as screw 135 is adjusted to the correct operating position. In the operating position, front lug surfaces 364, 365, 366, 367 are located behind rear housing flange surfaces 246, 247, to trap the support means 200 and prevent withdrawal until the armature is lowered. In the assembled position, upward and downward shifting movement of support means 200 is guided by slot side surfaces 222, 224 and side surfaces 308, 310 of body portion 300; flange front side surfaces 244, 245 and rear side surfaces 354, 356; flange rear side surfaces 246, 247, lug front side surfaces 364, 365, 366, 367; and rib front surface 233 and flange rear surface 312. When the armature is actuated, the slide means is forced upwardly against the bias of spring 390 to the shifted position without contact with any opposing abutment surface. The upper shifted position is determined solely by the ratio of armature force to spring force which may be adjusted by screw 135.

In the embodiment of FIGS. 35–38, one row of bearing holes 400 is located in a first wire end bearing plate 402 having three side edge surfaces 404, 406, 408 and a rear side surface 409 fixedly mounted in a three sided housing slot means 410 and one side edge surface 412 located on center line 414 opposite a slot means 416 which receives a shiftable bearing plate support means 420 carrying a second wire end bearing plate 422 providing a second row of wire bearing holes 424 adapted to be located in staggered offset relationship to the row of fixed holes 400 in an unshifted position and in aligned relationship therewith in a shifted position.

Figure 38:
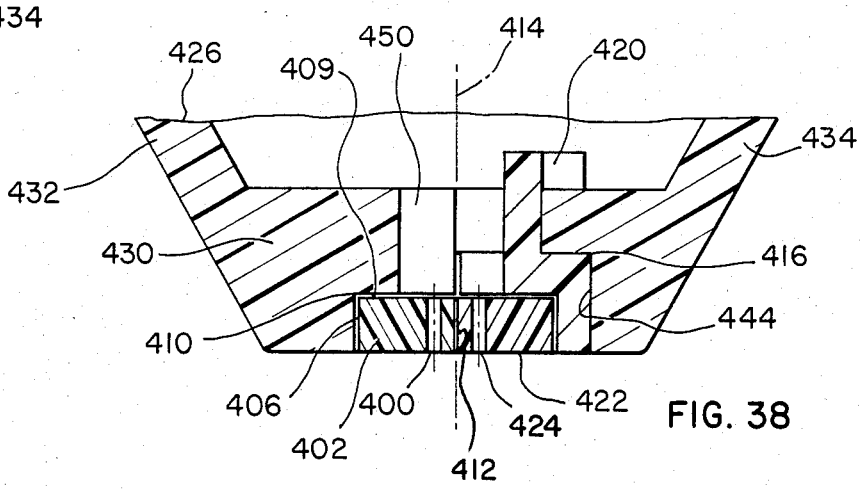
FIG. 38 is a sectional view taken along line 38—38 in FIG. 37.
Figure 39:
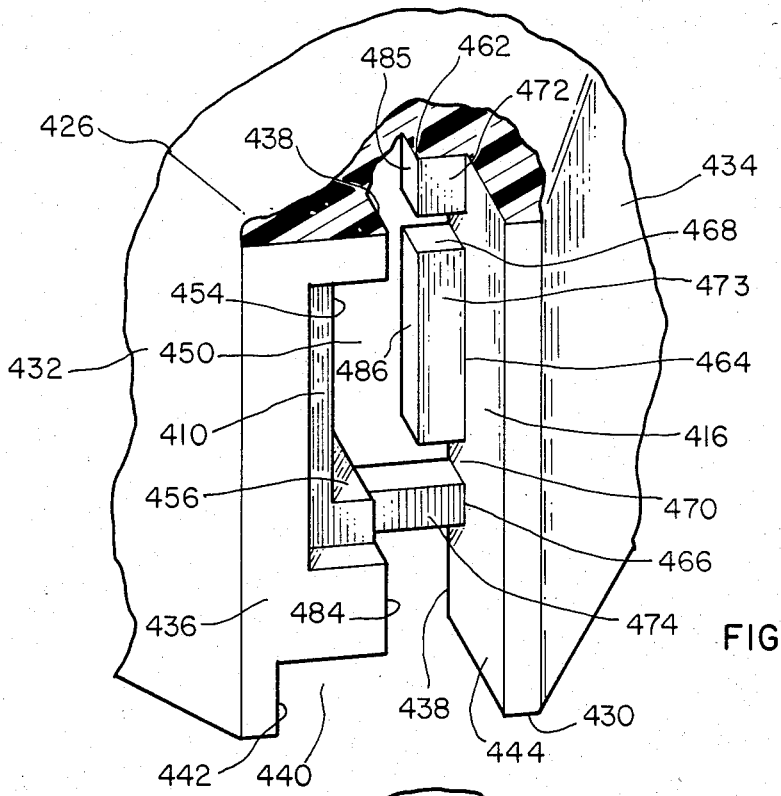
FIG. 39 is a schematic perspective view of the wire housing portion of FIG. 35.
Figure 40:
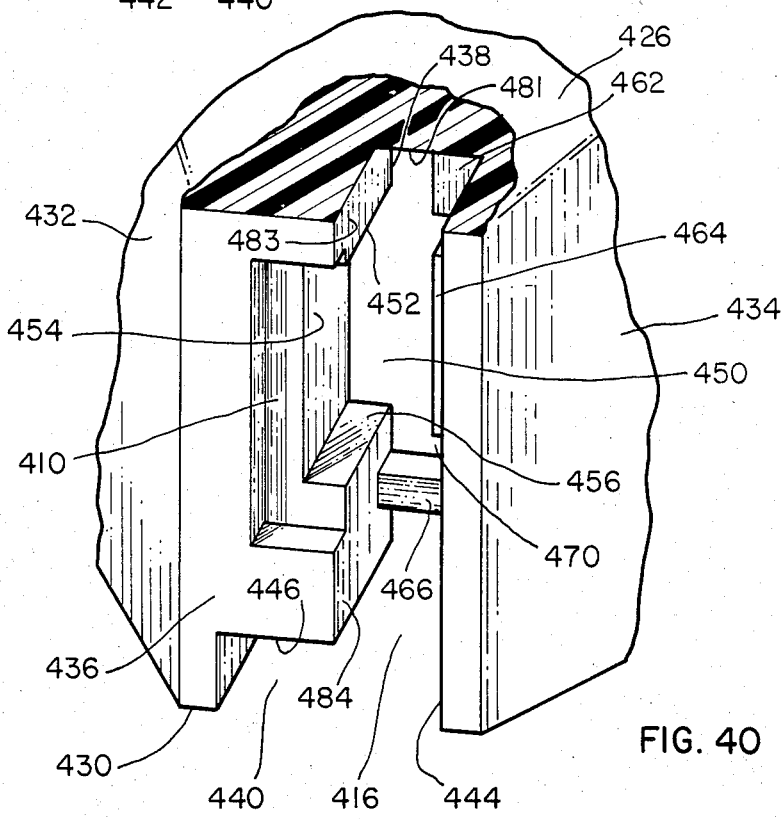
FIG. 40 is another schematic perspective view of the wire housing portion of FIG. 35.

As shown in FIGS. 38–40, the front end portion 426 of wire housing means 428 is modified to provide wire bearing plate mounting means comprising a front end wall portion 430, extending between tapered side wall portions 432, 434 of wire housing end portion 426, and having front and rear side surfaces 436, 438. An armature slot 440 defined by side surfaces 442, 444, 446 is provided at the bottom of wall portion 430 to receive the front end portion of armature 94. A generally rectangular fixed wire passage slot means 450 defined by spaced side surfaces 452, 454, 456 extends through one side of end wall portion 430 and is connected to fixed wire bearing plate slot 410. Shiftable bearing plate support means 420 is mounted in adjoining slot means 416 defined in part by flange porrions 462, 464, and rib portion 66 separated by slot portions 468, 470 and having coplanar front surfaces 472, 473, 474, coplanar rear surfaces 475, 476, 478 FIG. 35 and coplanar side surfaces 485, 486, FIG. 39. Slot means 416 further comprises opposite upper and lower end surfaces 481, 482, coplanar upper and lower side surfaces 483, 484, and flange side surfaces 485, 486.

Figure 41:
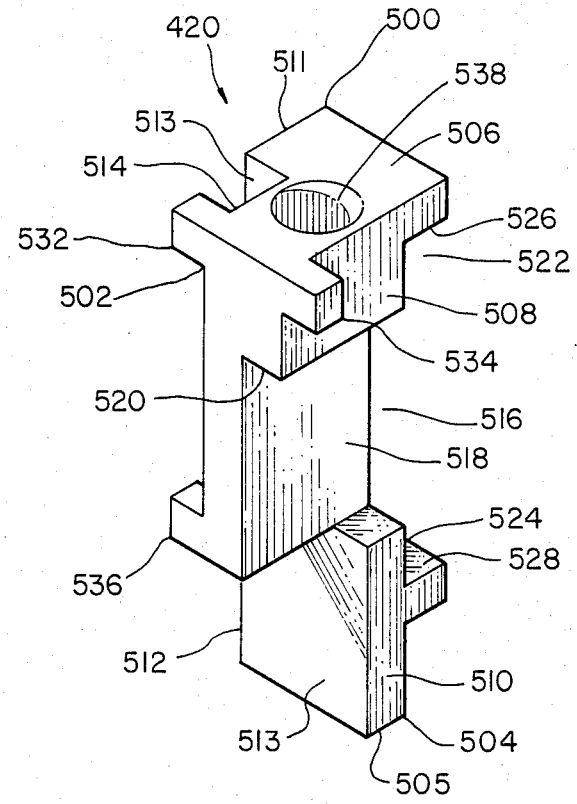
FIG. 41 is a perspective view of the shiftable bearing plate support means of FIG. 37.
Figure 42:
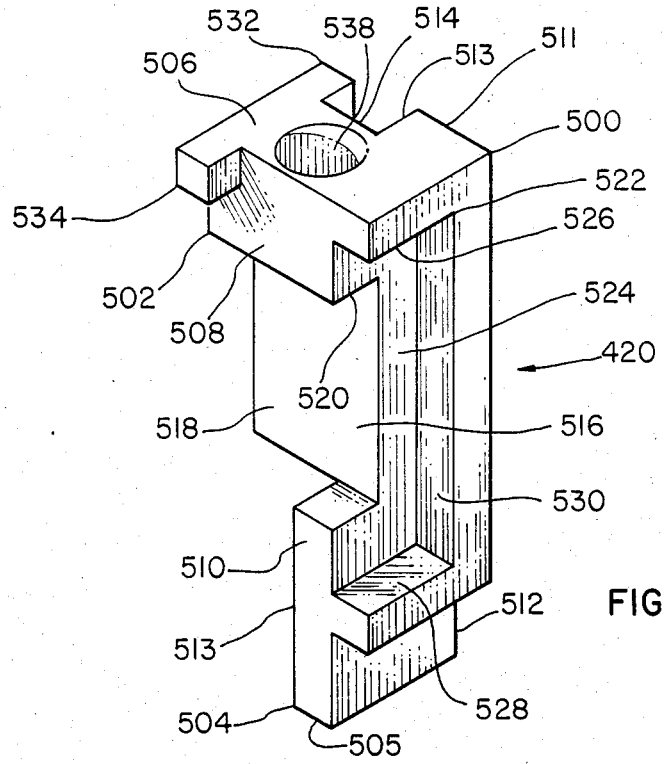
FIG. 42 is another perspective view of the support means of FIG. 41.

As shown in FIGS. 41–42, the wire bearing plate support means 420 is made of one piece of molded plastic material such as LNP RFL 4536 Natural White Nylon 6-6 with 30% glass fibers, 13% PTFE, and 2% silicone (by weight). Support means 420 comprises a front body portion 500, a rearwardly extending rib portion 502, and a lower flange portion 504 which has a flat lower surface 505. Portions 500, 502 have a common flat upper surface 506 and a common flat side surface 508 which is coplanar with flange side surface 510. Portion 500 has a flat side surface 511 which is coplanar with flange side surface 512 and a rear flat side surface 513 extending transversely to rib side surface 514. A vertically elongated wire slot 516, defined by side surface 518 and upper surface 520, extends axially along one side of body portion 500 and rib portion 502 to a transverse wire bearing plate slot 522 defined by a flat bottom surface 524, upper and lower side surfaces 526, 528, and a vertical side surface 530. Retaining means in the form of a pair of upper lug portions 532, 534 and a lower lug portion 536, are provided at rear corners of rib portion 502. A spring cavity 538 is provided in body portion 500 and rib portion 502. The construction and arrangement is such as to enable assembly as previously described by axial inward sliding movement with lug portions 532, 536 passing through slots 468, 470, FIGS. 31 & 40, and lug portion 534 passing through slot 450 before bearing plate 402 is mounted in slot means 410. In the assembled operative position, shiftable bearing support plate means 420 is supported in an upwardly displaced position by engagement of lower flange surface 505 with the upper armature surface as previously described whereby lug portions 532, 534, 536 are located behind rear surfaces 475 & 476, respectively. Rear surface 513 is located in juxtaposition to front side flange surfaces 472, 473, 374. Side surface 511 is located in juxtaposition to slot side surface 444 and rib side surface 514 is located in juxtaposition to flange side surfaces 485, 486. In this manner, shiftable bearing plate support means 420 is selectively laterally movable upwardly and downwardly by actuation and deactuation of the armature. Bearing plate 422 is fixedly mounted in slot 522 on surfaces 524, 526, 528, 530 with side edge surfaces parallel and coplanar with side surfaces 483, 484.

In operation, shiftable bearing plate support means 420 and bearing plate 422 carried thereby are selectively movable relative to fixed bearing plate means 402 from an unshifted position whereat the hole centers of the row of holes 400 are laterally offset from the hole centers of the row of holes 424, to a shifted position whereat the centers of the rows of holes are laterally aligned. For example, the centers of the nine holes of each row may offset from one another a distance of 0.014 inch and the centers of the holes in one row are staggered relative to the centers of the holes in the other row by a distance 0.007 inch in the unshifted position. In the shifted position, the centers of holes in each row are aligned as a result of movement of bearing plate means 422 a distance of 0.007 inch.

The present invention therefore provides a matrix print head output guide shifter which is simple to fabricate and reliable in operation. Device of the present invention can be fabricated from molded plastic pieces and simple flat metal stampings so as to reduce the cost of fabrication. The present invention is efficient, compact, less massive than prior art matrix print heads, and can be quickly assembled and adjusted. The entire shift mechanism consists of only two moving parts to produce the shifted imprintation. This further reduces costs of fabrication and reliability of operation.

The present invention may be employed with various kinds of wire matrix print heads employing various numbers of print wires arranged in various patterns. For example, an eighteen wire print head may have two horizontally offset columns of 9 wires with one column offset vertically by one-half dot. A nine wire print head may have one column of 5 wires and one column of 4 wires. The electromagnetic shift apparatus may be designed to operate on a relatively low supply voltage of 5 to 60 VDC (limited to 2 watts continuous power) and a resistance of 290 ohms with relatively high speed (e.g., 350 to 650 or more characters per second), wire matrix print head apparatus.

The foregoing description of the invention has been presented for purposes of illustration and description. It is not intended to be exhaustive or to limit the invention to the precise form disclosed, and other modifications and variation may be possible in light of the above teachings. For example, the basic shifting mechanism illustrated in the above description can be used to shift a single one-piece output guide as disclosed above, or can be used to shift one half of a two-piece guide, such as described in U.S. Pat. No. 4,010,835. The embodiment was chosen and described in order to best explain the principles of the invention and its practical application to thereby enable others skilled in the art to best utilize the invention in various embodiments and in various modifications as are suited to the particular use contemplated. It is intended that the appended claims be construed to include other alternative embodiments of the invention except insofar limited by the prior art.

What is claimed is:

1. A wire print head assembly comprising:

a plurality of wire print means having drive end portions mounted in a circular array and print end portions mounted in at least one linear array for printing characters composed of a series of adjacent circular dots;

wire actuating armature means and associated electromagnetic means mounted in a circular array in operative association with said drive end portions of said wire print means for actuating said wire print means in a longitudinal direction between a retracted non-print positon and an extended print position;

elongated wire housing means for receiving said wire print means and being made of one piece of molded plastic material, and having a rear end portion located in fixedly mounted juxtaposition to said electromagnetic means and said wire actuating armature means for receiving said drive end portions of said wire print means, and having a front end portion for receiving said print end portions of said wire print means;

wire bearing plate means having a plurality of wire bearing hole means arranged in at least one linear array of bearing holes for receiving and axially slidably supporting said print end portions of said wire print means;

shiftable bearing plate support means made of one piece of molded plastic material for fixedly mounting and suppoting said wire bearing plate means and being mounted within said wire housing means for selective transverse shifting movement relative to said longitudinal direction of movement of said wire print means between a first unshifted print position and a second transversely shifted print position;

support and guide means including slidably engageable side wall portions of said wire housing means and side wall portions of said shiftable bearing plate support means for slidably supporting said shiftable bearing plate support means in said front end portion of said wire housing means for movement between said first unshifted print position and said second transversely shifted print position;

rigid non-flexible wire shift armature plate means pivotally mounted in said wire housing means for pivotal movement therein by pivotal displacement thereof between a non-shift position and a shift position, and being operatively associated with said shiftable bearing plate support means for causing transverse shifting movement of said shiftable bearing plate support means between said first unshifted print position and said second transversely shifted print position; and electrically energizable magnetic means mounted in said wire housing means in juxtaposition to said wire shift armature plate means for causing pivotal movement of said wire shift armature plate means between said non-shift position and said shift position to selectively effect movement of said shiftable bearing plate support means between said first unshifted print position and said second transversely shifted shift print position.

2. The invention as defined in claim 1 and further comprising:

pivotal support means for mounting said shiftable bearing plate support means in said wire housing means for pivotal movement relative thereto.

3. The invention as defined in claim 1 and further comprising:

support means for mounting said shiftable bearing plate support means in said wire housing means for transverse substantially linear sliding movement relative thereto.

4. The invention as defined in claim 1 and wherein said side wall portions of said wire housing means comprise a pair of spaced generally parallel side wall portions, and said wire housing means further comprises:

a transverse connecting wall portion, an elongated cavity defined by said side wall portions and said connecting wall portion, an elongated opening opposite said connecting wall portion, and a wire outlet opening at said front end portion of said wire housing means.

5. The invention as defined in claim 4 and wherein said shiftable bearing plate support means further comprises:

a main front body portion having a front surface and a flat upper surface;

downwardly extending flange means for operative abutting engagement with said wire shaft armature means;

forwardly facing bearing plate cavity means centrally located in said front surface for receiving said wire bearing plate means; and rearwardly extending support and retaining means for engaging said side wall portions of said wire housing means.

6. The invention as defined in claim 5 and wherein said rearwardly extending support and retaining means comprises:

a rearwardly extending rib portion of smaller size cross-section than said main front body portion; and a plurality of lug means on said rearwardly extending rib portion for retaining said shiftable bearing plate support means in said wire housing means and enabling linear shifting movement thereof.

7. The invention as defined in claim 5 and wherein said rearwardly extending support and retaining means comprises:

a pair of spaced parallel rearwardly extending support arm portions; and transverse connecting portion means between said support arm portions for pivotally supporting said shiftable bearing support means.

8. The invention as defined in claims 6 or 7 and further comprises:

a spring means mounted between said wire housing means and said shiftable bearing plate support means for biasing said shiftable bearing plate support means toward said wire shift armature means to maintain said abutting engagement between said downwardly extending flange means and said wire shift armature means.

9. The invention as defined in claim 4 and wherein:

said shiftable bearing plate support means being of a size and shape and constructed and arranged for mounting in said wire housing means by longitudinal sliding movement through said wire outlet opening between an assembled operating position and a disassembled non-operating position.

10. The invention as defined in claim 9 and wherein:

said wire shift armature means and electrically energizable magnetic means being of a size and shape and constructed and arranged for mounting in said wire housing means by transverse movement through said elongated opening between an assembled operating position and a disassembled non-operated position, and said wire print means being located between said transverse connecting wall portion of said wire housing means and said wire shift armature means.

11. The invention as defined in claim 4 and wherein said shiftable bearing plate support means comprising:

a one piece block of molded plastic material having an enlarged front end portion with a forwardly facing cavity;

said wire bearing plate means being fixedly mounted in said cavity;

a reduced width rib portion extending rearwardly from said front end portion through a mounting slot in said wire housing means;

a wire slot extending through said front end portion and said rib portion and said wire members extending forwardly through said wire slot to said wire end bearing plate means;

a downwardly extending flange portion having a lowermost surface operably abuttingly engaged with an upper surface of an operating end portion of said wire shift armature means;

a spring cavity in said block opposite said downwardly extending flange portion; and a compression spring in said spring cavity and having an end portion in abutting engagement with said wire housing means and biasing said block toward said operating end portion of said wire shift armature means and enabling movement of said block between said first print position and said second print position.

12. The invention as defined in claim 4 and wherein said shiftable bearing plate support means comprising:

a one piece member made of molded plastic material and having a rectangularly shaped front end portion with a forwardly facing cavity for receiving and supporting said wire bearing plate means, a pair of rearwardly extending spaced support arm means for supporting said front end portion, connecting means for connecting rear end portions of said support arm means; and resilient spring finger means extending forwardly from said connecting means for engaging a wall portion of said wire housing means and exerting a downwardly directed biasing force on said front end portion.

13. The invention as defined in claim 12 and further comprising:

pivotal support means mounted in said housing means for pivotally supporting a rear end portion of said support arm means.

14. The invention as defined in claim 13 and wherein said pivotal support means comprising:

an intermediate wire guide and bearing plate member mounted in rearwardly spaced relationship to said front end portion.

15. The invention as defined in claim 4 and wherein said support and guide means comprising:

transversely inwardly etending rib portion means on said wire housing means adjacent said wire outlet opening for providing a central slot and at least two parallel guide surfaces;

said shiftable bearing plate support means having a cross-sectional configuration of smaller corresponding size relative to said central slot and being constructed and arranged for slidable inward and outward movement to and from a normal operating position in said central slot during assembly and disassembly;

at least two parallel guide surface means on said shiftable bearing plate support means for slidable engagement with said two parallel guide surfaces on said rib portions in the operating position to define a linear path of movement between said first print position and said second print position; and mutually engageable abutment means on said wire housing means and said shiftable bearing plate support means for releasably retaining said shiftable bearing plate support means in the normal operative position.

16. The invention as defined in claim 15 and wherein said abutment means comprising:

laterally outwardly extending lug portions on said shiftable bearing plate support means;

notch means on said rib portions corresponding to the shape of said leg portions for enabling longitudinal sliding movement of said lug portions through said notch means during assembly and lateral movement after assembly to the operating position; and oppositely facing abutment surface means on said lug portions and on said rib portions adjacent said notch means for preventing longitudinal movement of said shiftable means after location in the normal operating position.

17. The invention as defined in claim 16 and wherein said shiftable bearing plate support means comprising:

a one piece member made of molded plastic material and having a rectangularly shaped front end portion with a forwardly facing cavity for receiving said bearing plate means, a rearwardly extending rib portion having a width less than the width of said front end portion and said lug portions being located on a rear end portion of said rib portion, a flange portion extending downwardly from said front end portion for operative engagement with said wire shift armature means, and a wire slot extending through said front end portion and said rib portion for receiving said wire print means.

18. The invention as defined in claim 17 and wherein said shiftable bearing plate support means and said wire bearing plate means support all of said wire print means.

19. The invention as defined in claim 17 and wherein:

said shiftable bearing plate support means and said wire bearing plate means support only one of a plurality of rows of said wire print means; and a second wire bearing plate means fixedly mounted in said wire housing means adjacent said shiftable bearing plate support means for supporting another one of the plurality of rows of said wire print means.

20. A matrix print head wire print position shift apparatus comprising:

longitudinally movable wire print means having print end portions and drive end portions and being spaced about a longitudinal axis and being longitudinally movable between a non-print position and a print position;

elongated wire housing means for housing said movable print wire means having a print end portion and a drive end portion and comprising a pair of spaced generally parallel side wall portions, a transverse connecting wall portion, an elongated cavity defined by said side wall portions and said connecting wall portion, an elongated opening opposite said connecting wall portion, and a wire outlet opening at said print end portion of said wire housing means;

guide means mounted in said elongated cavity in said wire housing means for movable supporting said longitudinally movable wire print means;

wire drive armature means for inducing movement in said longitudinally movable wire print means between said non-print position and said print position;

wire drive magnetic means for causing pivotal movement of said wire drive armature means and movement of said wire print means from said non-print position to said print position in response to magnetic flux produced in said wire drive armature means;

a wire drive apparatus housing means fixedly secured to said drive end portion of said wire housing means for housing said wire drive armature means and said wire drive magnetic means;

wire print end bearing plate means adjacent said wire outlet opening in said wire housing means for supporting said print end portions of said longitudinally movable wire print means in closely spaced juxtaposition in substantially tangential relationship in at least one linear array;

shiftable bearing plate support means mounted in said cavity in said wire housing means adjacent said wire outlet opening for supporting said wire print end bearing plate means and being transversely movable relative to said wire housing means between a first unshifted print position whereat said wire print means are selectively operable to print characters defined by a first set of adjacent, substantially tangential circularly shaped dots approximately equal in diameter to the diameter of front print end portions of said wire print means and a second shifted print position whereat said wire print means are again selectively operable to repeat printing of said characters with a second set of overlapping circular dots which are offset from said first set of dots by approximately one half of said diameter of said first set of dots;

said shiftable bearing plate support means comprising an elongated body portion extending transversely across said cavity in said wire housing means and having transversely extending first parallel guide surface means for slidably guiding said shiftable bearing plate support means during transverse movement relative to said wire housing means;

second parallel guide surface means on said wire housing means for cooperable slidable engagement with said first guide surface means; and selectively energizeable and de-energizeable wire shift electromagnetic means and wire shift armature means mounted in said cavity in said wire housing means adjacent to and being operably associated with said shiftable bearing plate support means for selectively moving said shiftable bearing plate support means and said wire print end bearing plate means and said print end portions of said wire print means between said first unshifted print position and said second shifted print position.

21. The apparatus of claim 20 wherein said wire shift electromagnetic means and said wire shift armature means comprises:

an elongated rigid non-flexible armature member pivotally mounted in said cavity in said wire housing means in generally parallel relationship to said wire print means and having a movable non-fixed drive end portion operatively associated with said shiftable bearing plate support means and a movable non-fixed pivot end portion rearwardly spaced from said shiftable bearing plate support means;

an elongated magnetic plate means mounted in said cavity in said wire housing means and disposed in a generally parallel relationship and proximate to said elongated armature member and having separate spaced parallel pole portions disposed adjacent said drive end portion of said elongated armature member; and electric coil shift means mounted circumjacent one of said pole portions for selectively generating a magnetic field to induce pivotal movement of said elongated armature member between a first non-shift position and a second shift position; and spring means mounted in said cavity in said wire housing means and being operatively associated with said shiftable bearing plate support mean to bias said shiftable bearing plate support means and said elongated armature member toward said first unshifted print position and away from said second shifted print position.

22. The apparatus of claim 21 and further comprising:

armature adjustment means operatively engageable with said drive end portion of said elongated armature member for selectively adjusting the amount of pivotal movement of said armature member.

23. The apparatus of claim 22 wherein said electric coil shift means further comprises:

a coil bobbin means having a rearwardly extending end flange portion with an abutment surface for engaging a rear end-portion of said elongated armature member to enable pivotal movement of said armature member from an energized position to a de-energized position and to cause said armature member to remain in contact with said elongated magnetic plate means for good magnetic flux transfer.

24. The device of claims 21, 22, or 23 and further comprising:

said spring means mounted in said wire housing means between said shiftable bearing plate support means and said wire housing means for enabling shifting movement thereof and maintaining said shiftable bearing support plate means in operative engagement with said armature member;

cavity means formed in a front end portion of said shiftable bearing plate support means for receiving and holding said wire end bearing plate means;

slot means aligned with said cavity means for receiving said wire print means; and abutment flange means connected to said shiftable bearing plate support means for abutting engagement with said armature member to cause movement of said shiftable bearing plate support means in response to movement of said armature member in a direction against a force produced by said resilient spring means so as to bias said shiftable bearing plate support means towards said armature member.

25. The apparatus of claim 21 wherein said shiftable bearing plate support means comprises:

elongated spaced parallel arm means coupled together at one end by an intermediate transverse connecting means to form a U-shaped cross-sectional configuration; and head means for supporting said wire bearing plate means mounted on an opposite end of said arm means;

said spring means comprising resilient spring finger means extending forwardly from said intermediate transverse connecting means and being spatially separated from said spaced parallel arm means;

cavity means formed in a front end portion of said head means for receiving and holding said wire bearing plate means;

slot means aligned with said cavity means for receiving said wire print means; and abutment flange means connected to said head means for engagement with said elongated armature member to cause movement of said head means in response to movement of said armature member in a direction against a force produced by said resilient spring finger means so as to bias said head means toward said armature member.

26. In a matrix print head having a plurality of longitudinally movable elongated wire print means operable in a longitudinal direction in a wire housing means between a print position and a non-print position, wire print means print position shfit apparatus comprising:

an elongated rigid non-flexible armature means pivotally supported by said wire housing means in parallel relationship with the elongated wire print means for producing a transverse shifting motion between a first non-shift position and a second shift position;

elongated rigid non-flexible magnetic plate means supported by said wire housing means and having a pair of spaced pole portions at one end thereof and being disposed in a generally parallel relationship and proximate to said armature means for producing a magnetic force to induce said shifting motion in said armature means;

electromagnetic coil means operatively associated with said magnetic plate means for creating a magnetic flux field;

electrical coil bobbin means mounted circumjacent said one of said pair of spaced pole portions for holding said electromagnetic coil means in a position to induce magnetic flux in said magnetic plate means to produce said magnetic force in response to selective energization of said electromagnet coil means;

said electrical coil bobbin means further comprises a laterally forwardly extending flange portion at one end of said electrical coil bobbin means;

armature adjustment means operatively mounted on said laterally forwardly extending flange portion for selective adjusting and being operatively engaged with said armature means; and laterally shiftable wire support means supported by said wire housing means and said armature means for supporting print end portions of said longitudinally movable wire print means and laterally moving said print end portion of said wire print means between a first non-shifted print position and a second shifted print position which is offset from said first non-shifted print position by an amount sufficient to substantially cover areas within a predetermined print zone which were not printed in said first non-shifted print position.

27. The apparatus of claim 26 wherein said electrical coil bobbin means further comprises:

biasing spring means at an opposite end of said electrical coil bobbin means having a rearwardly extending resilient flexible flange portion with an abutment surface for engaging a rear end-portion of said armature means to enable pivotal movement of said armature means from an energized position to a de-energized position and for causing said armature means to remain in contact with said magnetic plate for good flux transfer therebetween.

28. In a matrix print head having a plurality of longitudinally movable elongated wire print means operable in a longitudinal direction in a wire housing means between a print position and a non-print position, wire print means print position shift apparatus comprising:

an elongated rigid non-flexible armature means pivotally supported by said wire housing means in parallel relationship with the elongated wire print means for producing a transverse shifting motion between a first non-shift position and a second shift position;

elongated rigid non-flexible magnetic plate means supported by said wire housing means and having a pair of spaced pole portions at one end thereof and being disposed in a generally parallel relationship and proximate to said armature means for producing a magnetic force to induce said shifting motion in said armature means;

electromagnetic coil means operatively associated with said magnetic plate means for creating a magnetic flux field;

electrical coil bobbin means mounted circumjacent said one of said pair of spaced pole portions for holding said electromagnetic coil means in a position to induce magnetic flux in said magnetic plate means to produce said magnetic force in response to selective energization of said electromagnetic coil means;

laterally shiftable wire support means supported by said wire housing means and said armature means for supporting print end portions of said longitudinally movable wire print means and laterally moving said print end portions of said wire print means between a first non-shifted print position and a second shifted print position which is offset from said first non-shifted print position by an amount sufficient to substantially cover areas within a predetermined print zone which were not printed in said first non-shifted print position; and intermediate wire guide plate means having a plurality of wire bearing holes arranged in a non-linear array such that each of said wire bearing holes supports an intermediate portion of said longitudinally movable wire print members, said intermediate wire guide plate means having an abutment surface which engages said magnetic plate means.

29. In a matrix print head having a plurality of longitudinally movable elongated wire print means operable in a longitudinal direction in a wire housing means between a print position and a non-print position, wire print means print position shift apparatus comprising:

an elongated rigid non-flexible armature means pivotally supported by said wire housing means in parallel relationship with the elongated wire print means for producing a transverse shifting motion between a first non-shift position and a second shift position;

elongated rigid non-flexible magnetic plate means supported by said wire housing means and having a pair of spaced pole portions at one end thereof and being disposed in a generally parallel relationship and proximate to said armature means for producing a magnetic force to induce said shifting motion in said armature means;

electromagnetic coil means operatively associated with said magnetic plate means for creating a magnetic flux field;

electrical coil bobbin means mounted circumjacent said one of said pair of spaced pole portions for holding said electromagnetic coil means in a position to induce magnetic flux in said magnetic plate means to produce said magnetic force in response to selective energization of said electromagnet coil means;

laterally shiftable wire support means supported by said wire housing means and said armature means for supporting print end portions of said longitudinally movable wire print means and laterally moving said print end portions of said wire print means between a first non-shifted print position and a second shifted print position which is offset from said first non-shifted print position by an amount sufficient to substantially cover areas within a predetermined print zone which were not printed in said first non-shifted print position; and said laterally shiftable wire support means comprises:

sidewall means for slidably supporting engagement with side wall portions of the wire housing means;

retaining means for retaining said shiftable wire support means in the wire housing means;

an enlarged head means at the front end of said laterally shiftable wire support means having wire end bearing plate means for supporting print end portions of the elongated wire print means in at least one linear array;

resilient spring means between said shiftable wire support means and the wire housing means;

cavity means formed in a front end portion of said head means for receiving and holding said wire end bearing plate means;

slot means aligned with said cavity means for receiving said wire means; and abutment flange means connected to said head means and being separate from said armature means for only abutting engagement with said armature means to cause movement of said head means in response to movement of said armature means in a direction against a force produced by said resilient spring means so as to continually bias said head means towards and against said armature means.

30. A dot matrix print head assembly for printing characters by selective operation of a plurality of wire print members mounted in a circular array at one actuating end of the print head assembly and mounted in at least one linear array at the other print end of the print head assembly for longitudinal movement between an extended print position and a retracted non-print position and comprising:

an elongated wire housing means made of one piece of molded plastic material for receiving said wire print members, said elongated wire housing means having an elongated wire cavity of generally U-shape cross-sectional configuration defined by opposite-spaced side wall portions and an intermediate connecting wall portion and terminating in a print end portion having a generally U-shaped axially facing wire outlet opening;

intermediate wire guide and bearing means fixedly mounted in an intermediate portion of said wire housing means for supporting and guiding intermediate portions of said print wire members during movement between the retracted non-print position and the extended print position;

separate shiftable wire end bearing support means made of one piece of molded plastic material separately movably mounted in said wire housing means in juxtaposition to said wire outlet opening for lateral shifting movement between a first unshifted print position and an overlap shifted print position;

wire end bearing means mounted on said shiftable wire end bearing support means for supporting print end portions of said wire print members in at least one linear array and for lateral shifting movement with said shiftable wire end bearing support means;

rigid non-resilient non-flexible electromagnetic shift actuating means comprising an electromagnetic armature means being separate from said shiftable wire end bearing support means and separately pivotally mounted in said cavity means in said wire housing means in generally parallel relationship with said wire print members, and having axially spaced opposite armature end portions which are both movably mounted relative to said wire housing means with one of said armature end portions being non-fixedly operatively associated with said shiftable wire end bearing support means for pivotal movement in said cavity in said wire housing means between a first armature position whereat said shiftable wire end bearing support means is located in a said first unshifted print position and a second armature position whereat said shiftable wire end bearing support means is located in said second shifted print position transversely offset from said first unshifted print position; and oppositely facing flange means integrally formed in said side wall portions of said wire housing means adjacent said print end portion and providing aligned coplanar axially facing side surfaces for retaining said shiftable wire end bearing support means in said housing means and for guiding said shiftable wire end bearing support means during movement between said first unshifted print position and said second shifted print position.

31. The invention as defined in claim 30 and wherein:

said shiftable wire end bearing support means having laterally spaced lug portions for retaining said shiftable wire end bearing support means in said wire housing means; and said oppositely facing flange means having aligned notches for receiving said lug portions and enabling passage of said lug portions by relative axial movement during assembly of said shiftable bearing support plate means.

32. The invention as defined in claim 31 and further comprising:

compressible spring means mounted between said shiftable wire end bearing support means and said intermediate connecting wall portion of said wire housing means for exerting a lateral force against said shiftable wire end bcaring support means in a direction opposite the direction of movement from said first unshifted print position to said second shifted print position and for holding said shiftable wire end bearing support means and said electromagnetic armature means in said first unshifted print position until said electromagnetic armature means is selectively actuated.

33. The invention as defined in claims 30 or 31 and wherein said electromagnetic shift actuating means further comprises:

an elongated flat magnetic pole plate member separately fixedly mounted in said housing means in generally parallel relationship with said electromagnetic armature means and having a generally rectangular cross-sectional configuration and having a pair of laterally spaced pole portions at one end next adjacent said print end portion of said housing means; and an electrically energizable coil means mounted in said housing means on one of said pole portions for selectively creating magnetic flux.

34. The invention as defined in claims 30, 31 or 32 and wherein said shiftable wire end bearing support means comprising:

a body portion having a cavity therein for receiving and holding said wire end bearing means;

a rib portion extending axially rearwardly from said body portion; and a flange portion extending laterally downwardly from said body portion for continuous abutting engagement with said armature means.

35. The invention as defined in claim 34 and wherein said lug portions are located on said rib portion and have side surfaces for sliding abutting engagement with opposed surfaces of said flange means to prevent axial movement after assembly.

36. A wire matrix print head assembly comprising:

a plurality of elongated wire members having drive end portions mounted in a circular array and print end portions mounted in at least one linear array;

electromagnetic wire drive means including a plurality of armature members and a corresponding plurality of magnetic pole members and a corresponding plurality of electrically energizable magnetic coil means mounted in a circular array in juxtaposition to the drive end portions of said wire members for selectively driving each of said wire members between a retracted non-printing position and an extended printing position along a longitudinal path of movement;

wire drive housing means for supporting said electromagnetic drive means;

elongated wire housing means fixedly non-movably mounted on said wire drive housing means for providing an elongated chamber means for receiving said wire members;

intermediate guide and bearing means mounted in intermediate portions of said elongated chamber means for guiding and supporting intermediate portions of said wire members;

wire print end guide and bearing means mounted in a print end portion of said elongated chamber means for guiding and supporting print end portions of said wire members;

a separate shiftable print end bearing support plate means movably mounted in the print end portion of said elongated chamber means for supporting said wire print and guide and bearing means and enabling substantially linear displacement of said wire print end guide and bearing means substantially transversely to said longitudinal path of movement between a first unshifted print position and a second shifted print position;

support plate shift actuating means for actuating said print end bearing support plate means comprising a spring means for biasing said print end bearing support plate means toward and holding said print end bearing support plate means in one of said first unshifted print position and said second shifted print position, an elongated rigid non-flexible armature means being separate from and mounted in said elongated chamber means separately from said print end bearing support plate means in generally parallel relationship with said wire members and being pivotally selectively movable between a first non-shift position and a second shift position and being operably associated with said print end bearing support plate means by only abutting engagement therebetween for causing selective movement of said print end bearing support plate means between said first unshifted print position and said second shifted print position;

said support plate shift actuating means further comprising an elongated rigid non-flexible magnetic pole plate means separately mounted in said wire housing means in generally parallel relationship to the path of movement of said wire members, and a selectively actuable electric coil means operatively associated with said magnetic pole plate means for creating and dissipating a magnetic field causing operation of said armature means;

pivotal support means for movably supporting said armature means with one end of said armature means in abutting engagement with said print end bearing support plate means and for providing a pivotal axis extending generally transversely to said path of movement of said wire members and enabling pivotal movement of said one end portion of said armature means in a direction extending substantially transversely to the path of movement of said wire members;

all of said support plate shift actuating means being substantially located within said chamber means of said wire housing means; and guide and support means retaining and enabling movement of said print end bearing support plate means relative to said wire housing means including only cooperating support and guide abutment surfaces on said wire housing means and said print end bearing support plate means located within said chamber means of said wire housing means.

37. The invention as defined in claim 36 and wherein:

said print end bearing support plate means being constructed and arranged for pivotal displacement by said armature means along a relatively short length arc.

38. The invention as defined in claim 37 and wherein the length of said arc is less than 0.010 inch.

39. The invention as defined in claim 36 and wherein:

said print end bearing support plate means and said guide and support means for said print end bearing support plate means being constructed and arranged to cause only substantially linear movement of said print end bearing support plate means of less than the diameter of said wire members.

40. The invention as defined in any of claims 36–39 and wherein:

said wire housing means being made of one piece of molded plastic material and having a pair of spaced sidewall portions interconnected by a connecting wall portion and having an U-shape cross-sectional configuration with an elongated opening opposite said connecting wall portion and an U-shaped outlet opening at the print end portion thereof.

41. The invention as defined in claim 40 and wherein:

said wire housing means having opposed parallel guide surface means on said spaced sidewall portions adjacent said outlet opening for slidably receiving said print end bearing support plate means.

42. The invention as defined in claim 41 and wherein said print end bearing support plate means having opposed parallel guide surface means for slidable engagement with said spaced side wall portions of said wire housing means.

43. The invention as defined in claim 42 and wherein said wire housing means and said wire print end bearing support plate means having cooperable retaining means for enabling axial inward and outward movement of said wire print end bearing support plate means between an outwardly displaced disassembled inoperative position disassociated from said wire housing means and an inwardly displaced assembled operative position retainably associated with said wire housing means for lateral movement between said first unshifted print position and said second shifted print position.

44. The invention as defined in claim 43 and wherein said cooperable retaining means comprising:

a plurality of lug means and slot means enabling axial inward and outward sliding movement of said wire print end bearing support plate means through said wire outlet opening.

45. The invention as defined in claim 44 and wherein:

said slot means being located on said wire housing means; and said lug means being located on said wire print end bearing support plate means.

46. The invention as defined in claim 45 and wherein:

said retaining means further comprising an abutment surface means on said armature means and an abutment surface means on said wire print end bearing support means; and adjustable means for varying the spacial relationship of said armature means and said wire print end bearing support plate means relative to said housing means.

47. The invention as defined in claim 46 and wherein said magnetic pole plate means comprising:

an elongated plate member having a rectangular cross-sectional configuration with a mounting plate portion at one end having a width substantially equal to the width of said chamber between said side wall portions and a pair of separate parallelally extending pole portions at the opposite print end portion with a wire coil means mounted circumjacent one of said pole portions.

48. The invention as defined in claim 47 and further comprising:

bobbin means including a central intermediate plate member for supporting said wire coil means and having an end portion for providing said pivotal support means for said armature means and an opposite end portion located beneath said actuating armature end portion and supporting adjustment screw means for engaging said armature actuating end portion and adjustably locating said armature means relative to said support means.

49. A dot matrix print head assembly for printing characters by selective operation of a plurality of wire print members mounted in a circular array at one actuating end of the print head assembly and mounted in at least one linear array at the other print end of the print head assembly for longitudinal movement between a print position and a non-print positiond and comprising:

an elongated wire housing means made of one piece of molded plastic material for receiving said wire print members, said elongated wire housing means having an elongated wire cavity of generally U-shape cross-sectional configuration defined by opposite-spaced side wall portions and an intermediate connecting wall portion and terminating in a print end portion having a generally U-shape axially facing wire outlet opening;

intermediate wire guide and bearing means mounted in an intermediate portion of said wire housing means for guiding said print wire members during movement between the non-print position and the print position;

shiftable bearing support means made of one piece of molded plastic material mounted in juxtaposition to said wire outlet opening for lateral shifting movement between a normal print position and an overlap full line print position;

wire end bearing means mounted on said shiftable bearing support means for supporting the print end portions of said wire print members in at least one linear array and for substantially linear lateral shifting movement with said shiftable bearing support means; and electromagnetic armature means mounted in said wire housing means and bein pivotally movable between a normal print position and an overlap full line print position and being operatively associated with said shiftable bearing support means for selectively causing lateral shifting movement thereof;

oppositely facing flange means integrally formed in said side wall portions of said wire housing means adjacent said print end portion and providing aligned coplanar axially facing side surfaces for retaining said shiftable bearing support means in said housing means and for guiding said shiftable bearing support means during movement between said normal print position and said full line overlap print position;

said shiftable bearing support means having laterally spaced lug portions for retaining said shiftable bearing support means in operative position in said wire housing means;

said oppositely facing flange means having aligned notches for receiving said lug portions and enabling passage of said lug portions by relative axial movement during assembly of said shiftable bearing support plate means;

compressible spring means mounted between said shiftable bearing support means and said intermediate connecting wall portion of said wire housing means for exerting a lateral force against said shiftable bearing support means in a direction opposite the direction of movement from said normal print position to said full line overlap print position and for holding said shiftable bearing support means and said electromagnetic armature means in said normal print position until said electromagnetic armature means is selectively actuated;

said shiftable bearing support means having a body portion having a cavity therein for receiving and holding said wire end bearing means;

a rib portion extending axially rearwardly from said body portion; and a flange portion extending laterally downwardly from said body portion for abutting engagement with said armature means.

50. The invention as defined in claim 49 and wherein said lug portions are located on said rib portion and have side surface for sliding abutting engagement with opposed surfaces of said flange means to prevent axial movement after assembly.

51. The invention as defined in claim 49 and wherein said electromagnetic armature means comprising:

an elongated flat magnetic plate member fixedly mounted in said housing means and having a generally rectangular cross-sectional configuration and having a pair of laterally spaced pole portions at one end next adjacent said print end portion of said housing means;

an electrically energizable coil means mounted on one of said pole portions for selectively creating magnetic flux; and an elongated flat armature member pivotally mounted in said housing means in operative generally parallel juxtaposition to said magnetic plate member for pivotal movement between a normal print position and a full line overlap print position and having a print end portion extending into said print end portion of said housing means for operative engagement with said shiftable bearing support means.

52. A wire matrix print head assembly comprising:

a plurality of elongated wire members having drive end portions mounted in a circular array and print end portions mounted in at least one linear array;

electromagnetic wire drive means including a plurality of armature members and a corresponding plurality of magnetic pole members and a corresponding plurality of electrically energizable magnetic coil means mounted in a circular array in juxtaposition to the drive end portions of said wire members for selectively driving each of said wire members between a retracted non-printing position and an extended printing position along a longitudinal path of movement;

wire drive housing means for supporting said electromagnetic wire drive means;

elongated wire housing means fixedly non-movably mounted on said wire drive housing means for providing an elongated chamber means for receiving said wire members;

intermediate guide and bearing means mounted in intermediate portions of said elongated chamber means for guiding and supporting intermediate portions of said wire members;

print end guide and bearing means mounted in a print end portion of said elongated chamber means for guiding and supporting print end portions of said wire members;

print end support plate means movably mounted in the print end portion of said elongated chamber means for supporting said wire print end guide and bearing means and enabling substantially linear displacement of said wire print end guide and bearing means substantially transversely to said longitudinal path of movement between a first print position and a second overlap print position;

support plate actuating means for said print end support plate means comprising a spring means for biasing said print end support plate means toward and holding said print end support plate means in one of said print positions, an elongated armature means being pivotally selectively movable between a first print position and a second print position and being operably associated with said print end support plate means for causing selective movement of said print end support plate means between said first print position and said second overlap print position;

an elongated magnetic poly plate means mounted in said wire housing means in generally parallel relationship to the path of movement of said wire members, a selectively actuable electric coil means operatively associated with said magnetic pole plate means for creating and dissipating a magnetic field causing operation of said armature means; pivotal support mean for said armature means for providing a pivotal axis extending generally transversely to said path of movement of said wire members and enabling pivotal movement thereof in a direction extending substantially transversely to the path of movement of said wire members; and all of said support plate actuating means being substantially located within said chamber means of said wire housing means;

said wire housing means being made of one piece of molded plastic material and having a pair of spaced sidewall portions interconnected by a connecting wall portion and having an U-shape cross-sectional configuration with an elongated opening opposite said connecting wall portion and an U-shaped outlet opening at the print end portion thereof;

said wire housing means having opposed parallel guide surface means on said spaced sidewall portions adjacent said outlet opening for slidably receiving said print end support plate means;

said print end support plate means having opposed parallel guide surface means for slidable engagement with said spaced sidewall portions of said wire housing means;

said wire housing means and said wire print end support plate means having cooperable retaining means for enabling axial inward and outward movement of said wire print end support plate means between an outwardly displaced disassembled inoperative position disassociated from said wire housing means and an inwardly displaced assembled operative position retainably associated with said wire housing means for lateral movement between said first print position and said second print position;

said retaining means comprising a plurality of lug means and slot means enabling axial inward and outward sliding movement of said wire print end support plate means through said outlet opening in said wire housing means;

said slot means being located on said wire housing means; and said lug means being located on said wire print end support plate means;

said retaining means further comprising an abutment surface means on said armature means and an abutment surface means on said wire print end support means; and adjustable means for varying the spacial relationship of said armature means and said print end support plate means relative to said wire housing means.

53. The invention as defined in claim 52 and wherein said magnetic pole plate means comprising:

an elongated plate member having a rectangular cross-sectional configuration with a mounting plate portion at one end having a width substantially equal to the width of said chamber means between said side wall portions and a pair of separate parallelly extending pole portions at the opposite print end portion with a wire coil means mounted circumjacent one of said pole portions.

54. The invention as defined in claim 53 and further comprising:

bobbin means including a central intermediate plate member for supporting said wire coil means and having an end portion for providing said pivotal support means for said armature means and an opposite end portion located beneath said actuating armature end portion and supporting said adjustable means which comprises adjustment screw means for engaging said armature actuating end portion and adjustably locating said armature means relative to said support means.

* * * * *